US011591198B2

(12) United States Patent
Dieringer et al.

(10) Patent No.: US 11,591,198 B2
(45) Date of Patent: Feb. 28, 2023

(54) MATERIALS HANDLING VEHICLE HAVING TILTING FORK CARRIAGE ASSEMBLY WITH TELESCOPIC FORKS

(71) Applicant: Crown Equipment Corporation, New Bremen, OH (US)

(72) Inventors: Mark Stuart Dieringer, St. Marys, OH (US); Geoffrey Donald Lee, St. Marys, OH (US); Adam Richard Stahl, Celina, OH (US); Timothy Martin Schaeffer, Fletcher, OH (US)

(73) Assignee: Crown Equipment Corporation, New Bremen, OH (US)

( * ) Notice: Subject to any disclaimer, the term of this patent is extended or adjusted under 35 U.S.C. 154(b) by 214 days.

(21) Appl. No.: 16/885,402

(22) Filed: May 28, 2020

(65) Prior Publication Data

US 2020/0377352 A1 Dec. 3, 2020

Related U.S. Application Data

(60) Provisional application No. 62/854,498, filed on May 30, 2019.

(51) Int. Cl.
*B66F 9/16* (2006.01)
*B66F 9/12* (2006.01)
(Continued)

(52) U.S. Cl.
CPC ..... *B66F 9/16* (2013.01); *B66F 9/122* (2013.01); *B66F 9/127* (2013.01); *B66F 9/142* (2013.01); *B66F 9/147* (2013.01); *B66F 9/205* (2013.01)

(58) Field of Classification Search
CPC .. B66F 9/16; B66F 9/122; B66F 9/142; B66F 9/147; B66F 9/205
See application file for complete search history.

(56) References Cited

U.S. PATENT DOCUMENTS 3,387,731 A * 6/1968 Gibson ..... B66F 9/16 414/667
3,726,427 A * 4/1973 Carlund ..... B66F 9/16 414/642

(Continued)

FOREIGN PATENT DOCUMENTS

DE 2358923 A1 6/1975
JP 2005082366 A 3/2005
JP 4391173 B2 12/2009

OTHER PUBLICATIONS

International Preliminary Report on Patentability dated Nov. 16, 2021; International Application No. PCT/US2020/034775; International Bureau of WIPO; Geneva, Switzerland.

(Continued)

*Primary Examiner* — Mark C Hageman
(74) *Attorney, Agent, or Firm* — Stevens & Showalter LLP

(57) ABSTRACT

A materials handling vehicle including a load handling assembly having a mast assembly, and a fork carriage assembly including a fork support and at least one fork assembly, the at least one fork assembly including a first fork member, which is fixed to the fork support, and a second fork member. The vehicle includes a tilt assembly that tilts the fork support relative to the mast assembly such that a central axis of the at least one fork assembly is positionable in a plurality of different positions relative to a horizontal direction. The vehicle includes a fork extension/retraction assembly that moves the second fork member relative to the first fork member in a first direction that is parallel to the central axis such that the fork extension/retraction assembly selectively moves the second fork member toward or away from the fork support in the first direction.

34 Claims, 17 Drawing Sheets

(51) Int. Cl.
*B66F 9/14* (2006.01)
*B66F 9/20* (2006.01)

(56) References Cited

U.S. PATENT DOCUMENTS

| | | | | | |
|---|---|---|---|---|---|
| 3,998,345 | A * | 12/1976 | Fiehler | B66F 9/16 | 414/641 |
| 5,788,016 | A * | 8/1998 | Soulas | B66F 9/16 | 187/238 |
| 9,309,902 | B2 * | 4/2016 | Dammeyer | B66F 9/10 | |
| 10,640,349 | B2 * | 5/2020 | Prentice | B66F 9/146 | |

OTHER PUBLICATIONS

International Search Report and Written Opinion of the International Searching Authority dated Sep. 10, 2020 International Application No. PCT/US2020/034775; European Patent Office; Rijswijk, Netherlands.

Search Report dated Oct. 25, 2022; Chinese Application No. 202080038094.5; China National Intellectual Property Administration; Beijing, China.

Notification of the First Office Action dated Oct. 25, 2022; Chinese Application No. 202080038094.5; China National Intellectual Property Administration; Beijing, China.

* cited by examiner

MATERIALS HANDLING VEHICLE HAVING TILTING FORK CARRIAGE ASSEMBLY WITH TELESCOPIC FORKS

CROSS REFERENCE TO RELATED APPLICATION

This application claims the benefit of U.S. Provisional Patent Application Ser. No. 62/854,498, filed May 30, 2019, entitled "MATERIALS HANDLING VEHICLE HAVING TILTING FORK CARRIAGE ASSEMBLY WITH TELESCOPIC FORKS," the entire disclosure of which is hereby incorporated by reference herein.

TECHNICAL FIELD

The present embodiments relate to a materials handling vehicle having a tilting fork carriage assembly with telescopic forks.

BACKGROUND

Known materials handling vehicles include a power unit, a mast assembly, and a platform assembly that includes a fork carriage assembly coupled to the mast assembly for vertical movement relative to the power unit. The mast assembly and platform assembly may each include components that are controlled by a hydraulic working fluid, such as pressurized oil. Valves provided within hydraulic fluid circuits associated with the mast and platform assemblies may control the flow of the working fluid to the components for effecting various functions performed by the components, such as raising/lowering, traversing (also known as side shifting), and tilting of the fork carriage assembly.

SUMMARY

In accordance with a first aspect, a materials handling vehicle is provided. The materials handling vehicle comprises a load handling assembly including a mast assembly, and a fork carriage assembly comprising a fork support and at least one fork assembly, the at least one fork assembly including a first fork member, which is fixed to the fork support, and a second fork member. The materials handling vehicle further comprises a tilt assembly that tilts the fork support relative to the mast assembly such that a central axis of the at least one fork assembly is positionable in a plurality of different positions relative to a horizontal direction. The horizontal direction is defined with respect to a floor surface on which the vehicle is located. The materials handling vehicle further comprises a fork extension/retraction assembly that moves the second fork member relative to the first fork member in a first direction that is parallel to the central axis of the at least one fork assembly such that the fork extension/retraction assembly selectively moves the second fork member toward or away from the fork support in the first direction.

The tilt assembly may comprise at least one tilt cylinder assembly including a cylinder and a piston.

The extension of the piston may cause the tilt assembly to tilt the fork support relative to the mast assembly such that the fork support and the at least one fork assembly move into a tilt position, and a subsequent retraction of the piston may cause the tilt assembly to tilt the fork support relative to the mast assembly such that the fork support and the at least one fork assembly move into a home position.

The at least one tilt cylinder assembly may have direction of elongation generally in the vertical direction.

The materials handling vehicle may further comprise at least one cam assembly coupled to a corresponding tilt cylinder assembly, the cam assembly driven by the piston of the tilt cylinder assembly to tilt the fork support relative to the mast assembly.

The cam assembly may comprise a cam weldment including a roller stud that is not concentric with a bearing surface of the cam weldment.

Rotation of the cam weldment may cause the roller stud to move with an arc-like movement corresponding to the rotation of the cam weldment, wherein the arc-like movement tilts the fork support relative to the mast assembly.

The fork support may be tiltable by the tilt assembly such that the central axis of the at least one fork assembly is positionable up to about plus (+) or minus (−) 5 degrees relative to the horizontal direction.

The materials handling vehicle may further comprise a spacer structure that sets the central axis of the at least one fork assembly at a predetermined angle relative to the horizontal direction.

The vehicle may comprise two fork assemblies.

The second fork member may be positioned over the first fork member.

The materials handling vehicle may further comprise a power unit, a platform assembly including an operator compartment, and a main mast assembly, wherein the mast assembly comprises an auxiliary mast assembly. The main mast assembly may vertically move the platform assembly and the auxiliary mast assembly relative to the power unit.

A headlength of the load handling assembly, which headlength is defined as a length from an outer surface of the fork support opposite to the mast assembly, to an inner surface of the tilt assembly, may be less than about ten (10) inches.

The mast assembly may comprise a generally vertical first mast structure and a generally vertical second mast structure, wherein the second mast structure is rotatable relative to the first mast structure.

The headlength may encompass the fork support, the second mast structure, and the tilt assembly.

The tilt assembly may comprise at least one tilt cylinder assembly including a cylinder and a piston, the cylinder mounted to a flange that extends outwardly from the fork support toward the mast assembly.

The headlength may encompass the fork support, the second mast structure, the at least one tilt cylinder assembly, and the flange.

In accordance with a second aspect, a materials handling vehicle is provided. The materials handling vehicle comprises a power unit, a platform including an operator compartment, a load handling assembly including an auxiliary mast assembly, and a main mast assembly that moves the platform and load handling assembly relative to the power unit. The materials handling vehicle further comprises a fork carriage assembly comprising a fork support and first and second fork assemblies. Each of the first and second fork assemblies includes a first fork member, which is fixed to the fork support, and a second fork member. The materials handling vehicle further comprises a tilt assembly that tilts the fork support relative to the mast assembly such that a central axis of first and second fork assemblies is positionable in a plurality of different positions relative to a horizontal direction. The horizontal direction is defined with respect to a floor surface on which the vehicle is located. The materials handling vehicle further comprises a fork extension/retraction assembly that moves the second fork member of each fork assembly relative to the first fork member in a first direction that is parallel to the central axis of the first and second fork assemblies such that the fork extension/retraction assembly selectively moves the second fork members toward or away from the fork support in the first direction.

The tilt assembly may comprise first and second tilt cylinder assemblies, each including a cylinder and a piston.

The extension of the piston may cause the tilt assembly to tilt the fork support relative to the auxiliary mast assembly such that the fork support and the fork assemblies move into a tilt position, and a subsequent retraction of the piston may cause the tilt assembly to tilt the fork support relative to the mast assembly such that the fork support and the fork assemblies move into a home position.

The tilt cylinder assemblies may each have direction of elongation generally in the vertical direction.

The materials handling vehicle may further comprise first and second cam assemblies coupled to a corresponding tilt cylinder assembly, the cam assemblies driven by the piston of the corresponding tilt cylinder assembly to tilt the fork support relative to the auxiliary mast assembly.

Each cam assembly may comprise a cam weldment including a roller stud that is not concentric with a bearing surface of the respective cam weldment.

Rotation of each cam weldment may cause the corresponding roller stud to move with an arc-like movement corresponding to the rotation of the cam weldment, wherein the arc-like movement tilts the fork support relative to the auxiliary mast assembly.

The fork support may be tiltable by the tilt assembly such that the central axis of the fork assemblies is positionable up to about plus (+) or minus (−) 5 degrees relative to the horizontal direction.

The materials handling vehicle may further comprise a spacer structure that sets the central axis of the fork assemblies at a predetermined angle relative to the horizontal direction.

The second fork member of each fork assembly may be positioned over the corresponding first fork member.

A headlength of the load handling assembly, which headlength is defined as a length from an outer surface of the fork support opposite to the auxiliary mast assembly, to an inner surface of the tilt assembly, may be less than about ten (10) inches.

The auxiliary mast assembly may comprise a generally vertical first mast structure and a generally vertical second mast structure, wherein the second mast structure is rotatable relative to the first mast structure.

The headlength may encompass the fork support, the second mast structure, and the tilt assembly.

The tilt assembly may comprise first and second tilt cylinder assemblies, each including a cylinder and a piston, the cylinder of each tilt cylinder assembly mounted to a corresponding flange that extends outwardly from the fork support toward the auxiliary mast assembly.

The headlength may encompass the fork support, the second mast structure, the tilt cylinder assemblies, and the flanges.

BRIEF DESCRIPTION OF THE DRAWINGS

While the specification concludes with claims particularly pointing out and distinctly claiming the present embodiments, it is believed that the present embodiments will be better understood from the following description in conjunction with the accompanying Drawing Figures, in which like reference numerals identify like elements, and wherein:

DETAILED DESCRIPTION

Figure 1:
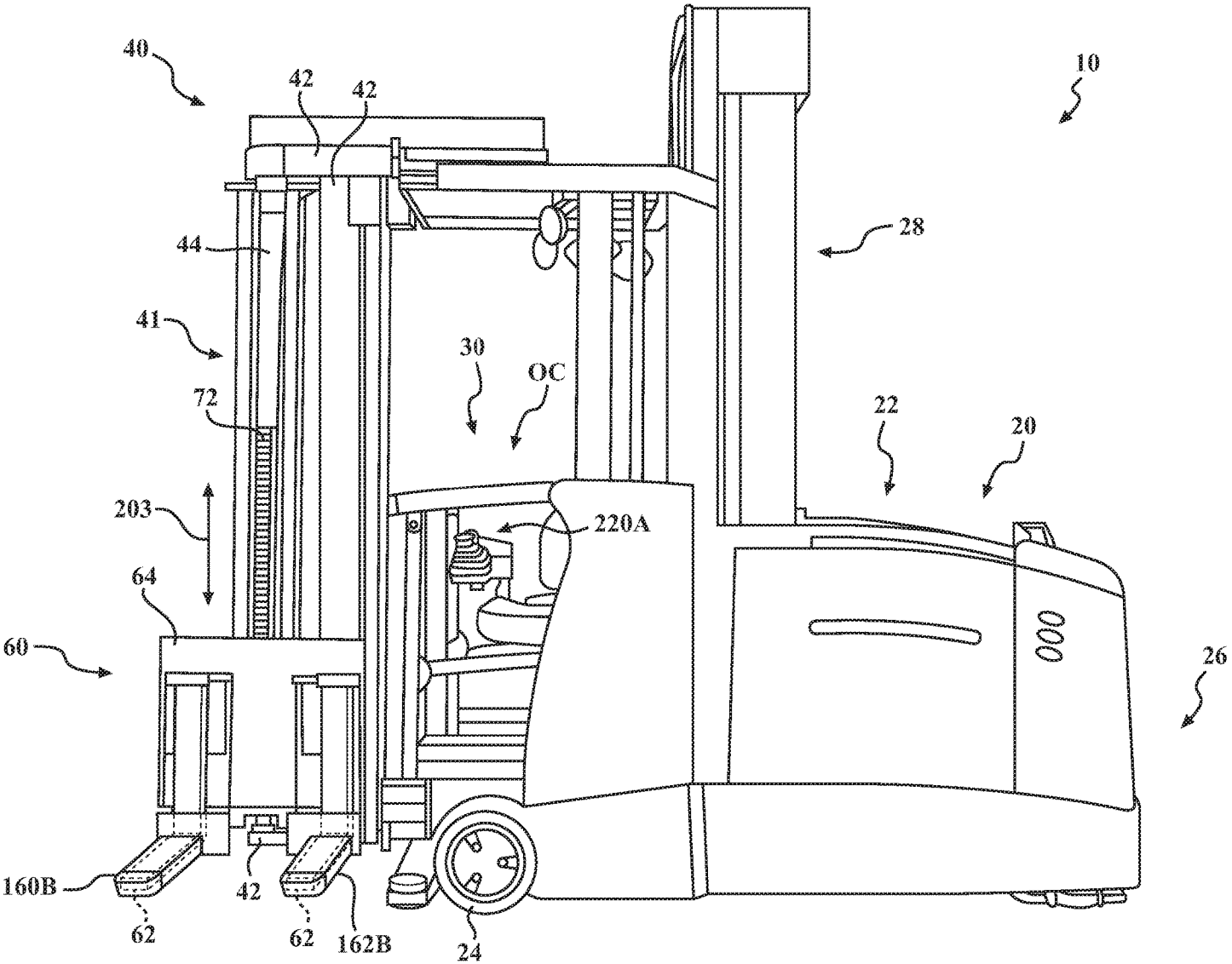
FIG. 1 is a side view of a materials handling vehicle constructed in accordance with embodiments.

The following text sets forth a broad description of numerous different embodiments of the present disclosure. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. It should be understood that multiple combinations of the embodiments described and shown are contemplated and that a particular focus on one embodiment does not preclude its inclusion in a combination of other described embodiments. Numerous alternative embodiments could also be implemented, using either current technology or technology developed after the filing date of this patent, which would still fall within the scope of the claims. All publications and patents cited herein are incorporated herein by reference.

Referring now to the drawings, and particularly to FIGS. 1-5, which illustrate a materials handling vehicle 10 constructed in accordance with embodiments. In the illustrated embodiment, the vehicle 10 comprises a turret stockpicker, such as the turret stockpicker disclosed in U.S. Pat. No. 7,344,000 entitled "ELECTRONICALLY CONTROLLED VALVE FOR A MATERIALS HANDLING VEHICLE," assigned to the applicant, Crown Equipment Corporation, the entire disclosure of which is hereby incorporated by reference herein. The vehicle 10 includes a power unit 20, a platform assembly 30 including an operator compartment OC, and a load handling assembly 40. The power unit 20 includes a power source, such as a battery unit 22, a pair of load wheels 24, see FIG. 5, positioned under the platform assembly 30, and a steered wheel 25, see FIG. 4, positioned under the rear 26 of the power unit 20. The vehicle 10 further comprises a main mast assembly 28 coupled to the power unit 20 on which the platform assembly 30 moves vertically. The main mast assembly 28 comprises a first mast 28*a* fixedly coupled to the power unit 20, and a second mast 28*b* movably coupled to the first mast 28*a*, see FIGS. 4 and 5. While the illustrated main mast assembly 28 includes two masts 28*a*, 28*b*, the main mast assembly 28 may include additional or fewer masts.

Figure 4:
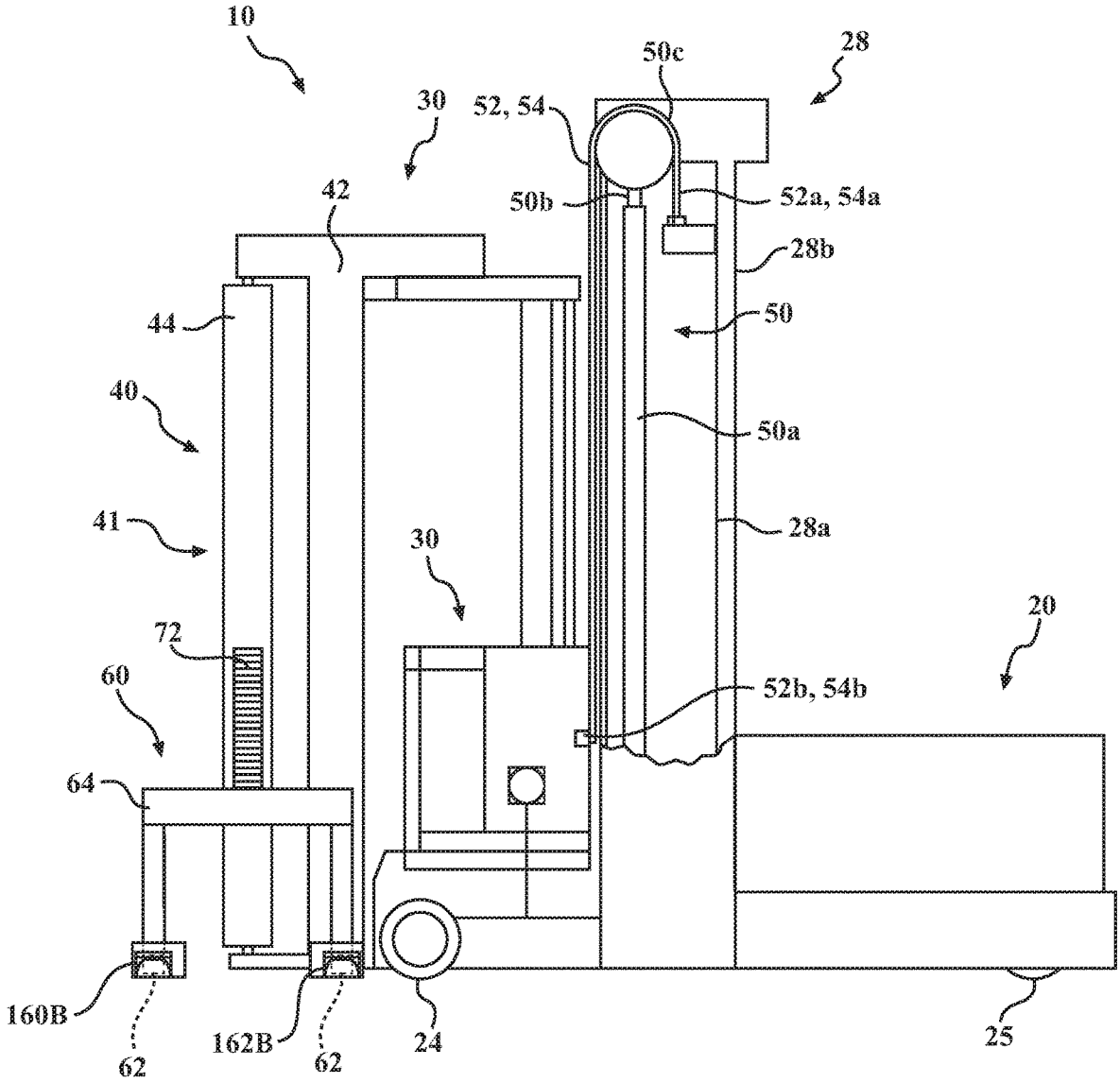
FIG. 4 is a schematic view of the vehicle of FIG. 1 illustrating the platform lift piston/cylinder unit.
Figure 5:
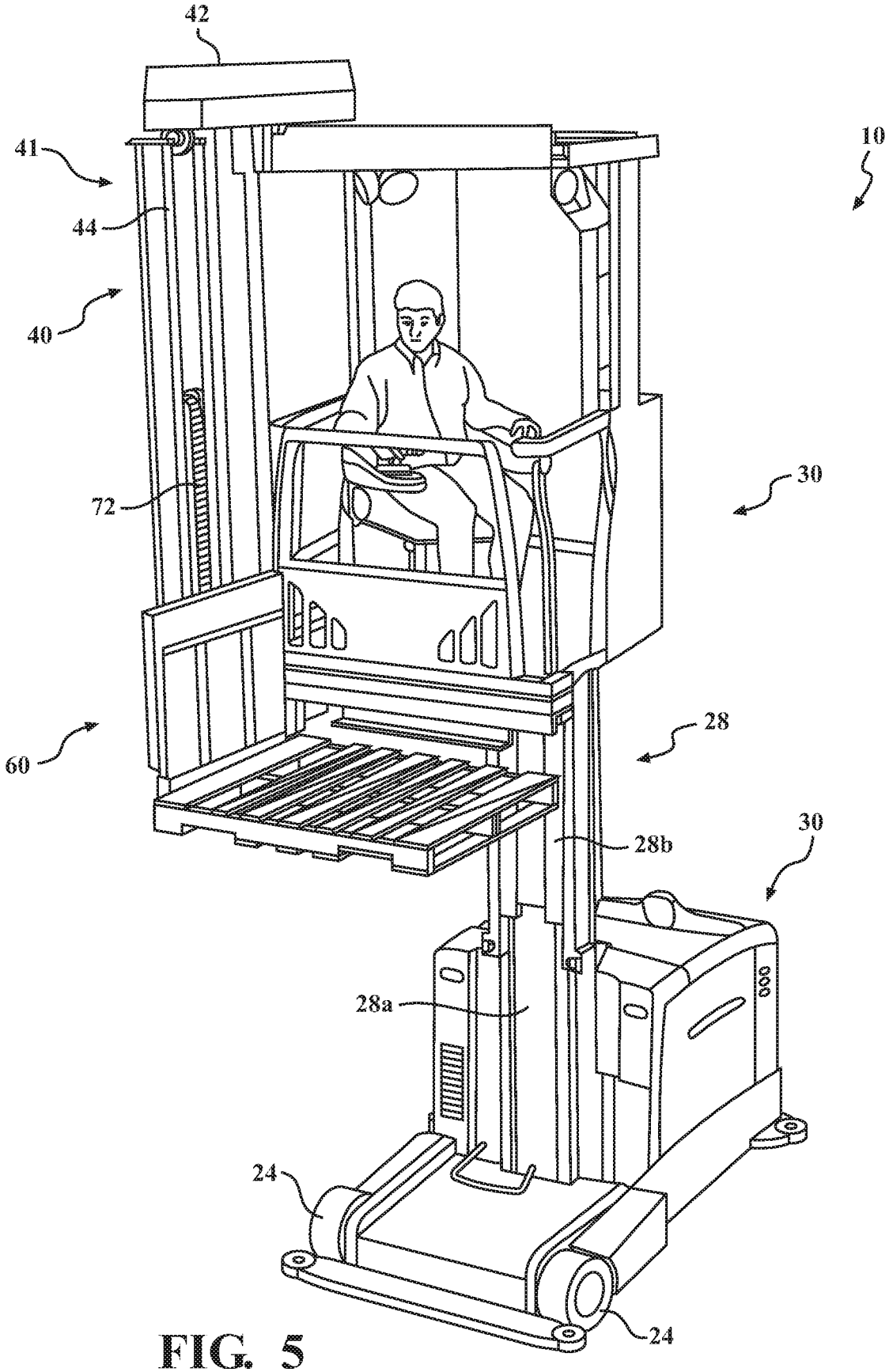
FIG. 5 is a perspective view of the vehicle illustrated in FIG. 1 with the platform assembly illustrated in an elevated position.

A main mast piston/cylinder unit 50 is provided in the first mast 28*a* for effecting vertical movement of the second mast 28*b* and the platform assembly 30 relative to the first mast 28*a* and the power unit 20, see FIG. 4. It is noted that a load handling assembly 40 (to be discussed in greater detail below) is mounted to the platform assembly 30; hence, the load handling assembly 40 moves with the platform assembly 30 when the main mast assembly 28 is raised or lowered. A cylinder 50*a* forming part of the piston/cylinder unit 50 is fixedly coupled to the power unit 20. A piston or ram 50*b* forming part of the piston/cylinder unit 50 is fixedly coupled to the second mast 28*b* such that movement of the piston 50*b* effects movement of the second mast 28*b* relative to the first mast 28*a*. The piston 50*b* comprises a pulley 50*c* on its distal end, which engages a pair of chains 52 and 54. One unit of vertical movement of the piston 50*b* results in two units of vertical movement of the platform assembly 30 and load handling assembly 40. Each chain 52, 54 is fixedly coupled at a first end 52*a*, 54*a* to the first mast 28*a* and coupled at a second end 52*b*, 54*b* to the platform assembly 30. Hence, upward movement of the piston 50*b* relative to the cylinder 50*a* effects upward movement of the platform assembly 30 and load handling assembly 40 via the pulley 50*c* pushing upwardly against the chains 52, 54. Downward movement of the piston 50*b* effects downward movement of the platform assembly 30 and load handling assembly 40. Movement of the piston 50*b* also effects movement of the second mast 28*b*.

Figure 2:
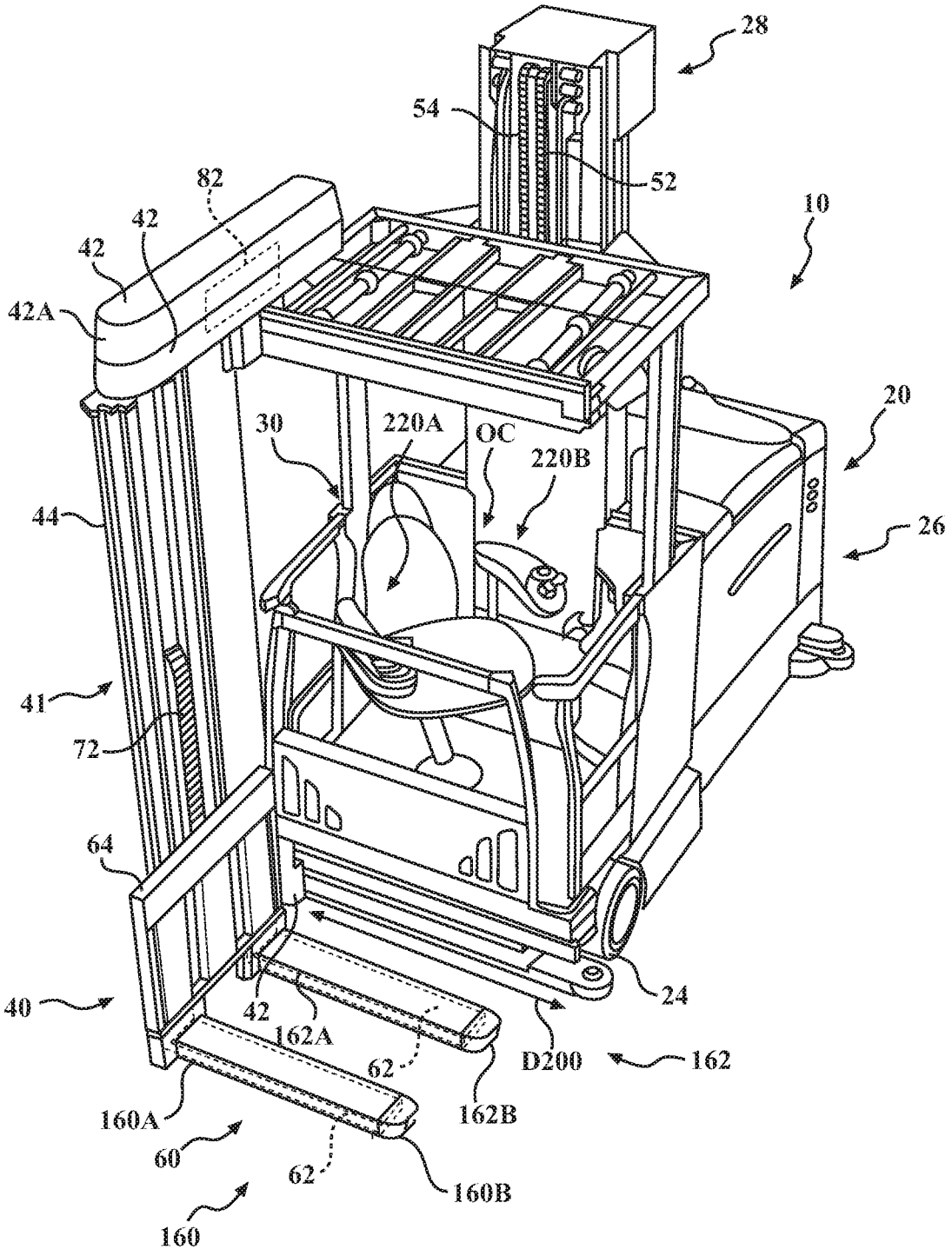
FIG. 2 is a perspective view of the vehicle illustrated in FIG. 1.
Figure 3:
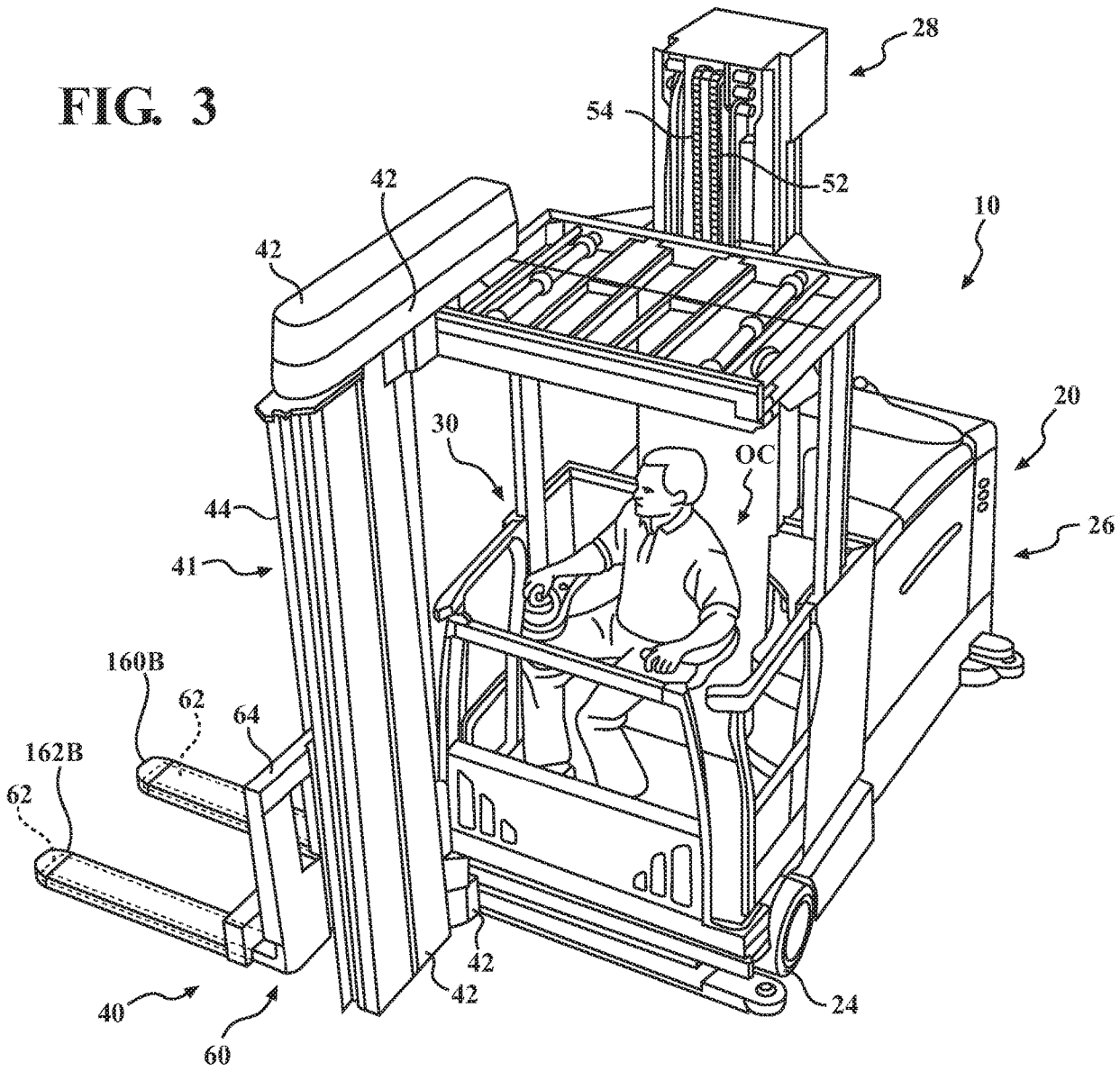
FIG. 3 is a perspective view of the vehicle illustrated in FIG. 1 and with the fork assembly rotated 180° from the position of the fork assembly shown in FIG. 2.
Figure 14:
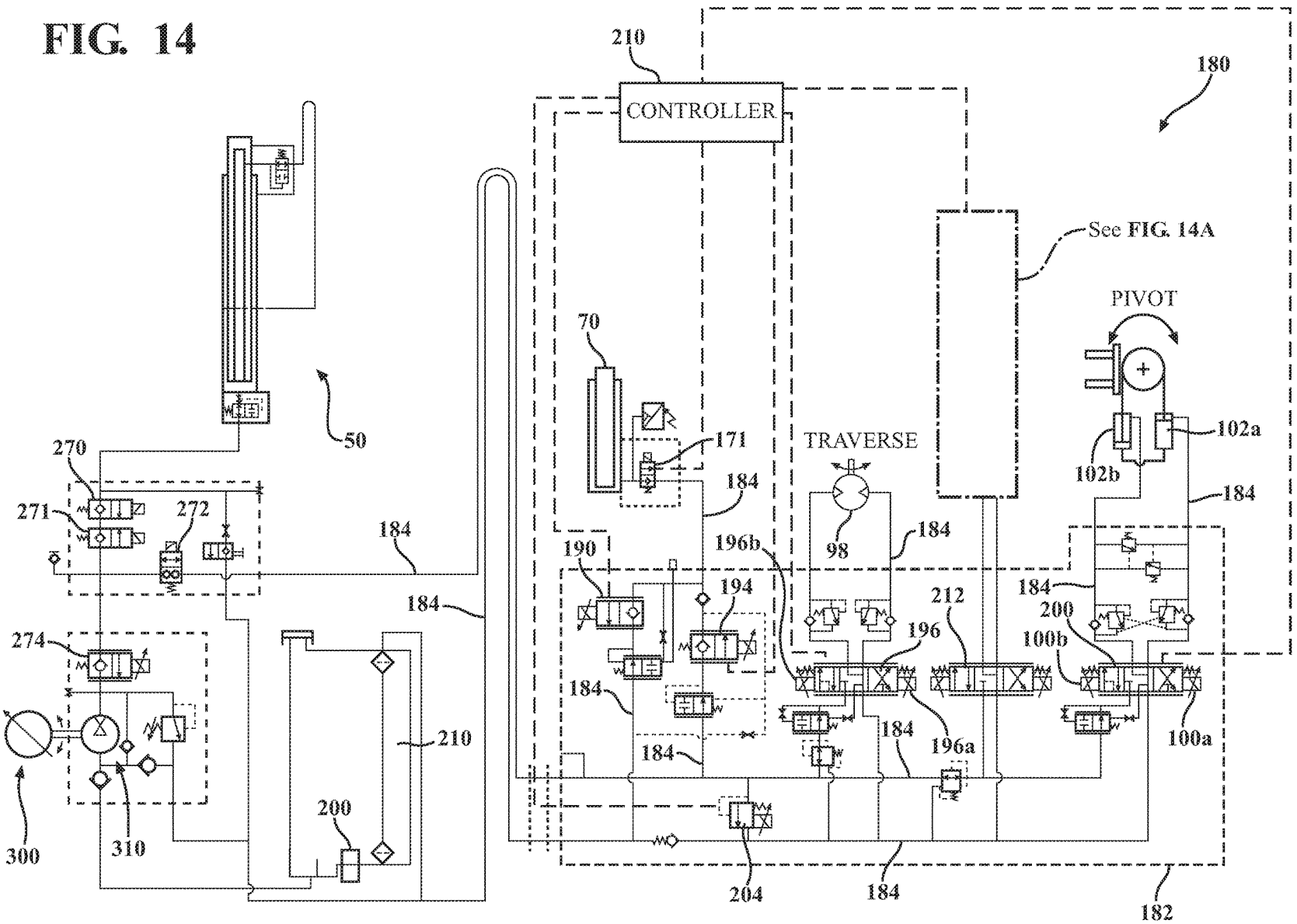
FIG. 14 illustrates a schematic diagram of a hydraulic circuit included in the vehicle of FIG. 1.

The load handling assembly 40 comprises an auxiliary mast assembly 41 including a first mast structure 42, which comprises a generally vertical mast structure that is movable back and forth transversely in a first direction relative to the platform assembly 30, as designated by an arrow D200 in FIG. 2, via a traverse hydraulic motor 98, see also FIGS. 3, 4 and 14. The auxiliary mast assembly 41 further comprises a second mast structure 44, which comprises a generally vertical mast structure that moves transversely with the first mast structure 42 and is also capable of rotating relative to the first mast structure 42 via first and second pivot piston/cylinder units 102*a* and 102*b*, see FIG. 14. In the illustrated embodiment, the second mast structure 44 is capable of rotating back and forth through an angle of about 180°.

Coupled to the second mast structure 44 of the auxiliary mast assembly 41 is a fork carriage assembly 60 comprising a pair of forks 62 and a fork support 64. The fork carriage assembly 60 is capable of moving vertically relative to the second mast structure 44, as designated by an arrow 203 in FIG. 1. Rotation of the second mast structure 44 relative to the first mast structure 42 permits an operator to position the forks 62 in one of at least a first position, illustrated in FIGS. 1, 2 and 4, and a second position, illustrated in FIG. 3, where the second mast structure 44 has been rotated through an angle of about 180° from its position shown in FIGS. 1, 2 and 4. The fork carriage assembly 60 will be described in more detail below.

Figure 11:
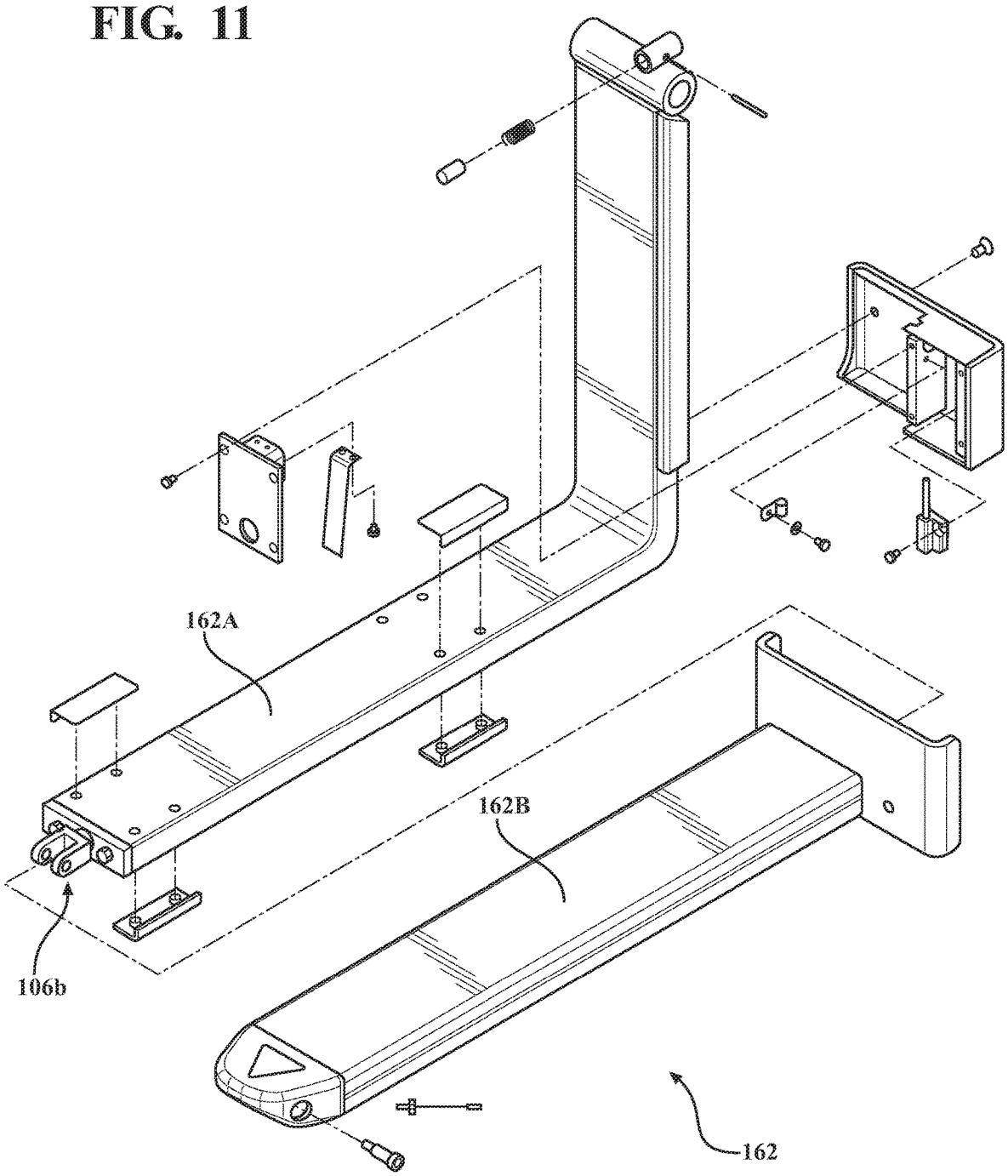
FIG. 11 is an exploded view of a fork assembly of the vehicle illustrated in FIG. 1.

According to embodiments, the forks 62 comprise a first fork assembly 160 and a second fork assembly 162, although additional or fewer fork assemblies may be included. The first fork assembly 160 comprises a first fork member 160A, which is fixed to the fork support 64, and a second fork member 160B positioned over the first fork member 160A. The second fork member 160B is movable in the direction of the arrow D200 shown in FIG. 2 relative to the first fork member 160A via a first extension piston/cylinder unit 106*a* of a fork extension/retraction assembly 106 (see FIG. 14A), the direction of the arrow D200 defining a direction of elongation of the first and second fork members 160A, 160B. With reference additionally to FIG. 11, the second fork assembly 162 comprises a first fork member 162A, which is fixed to the fork support 64, and a second fork member 162B. The second fork member 162B is movable in the direction of the arrow D200 shown in FIG. 2 relative to the first fork member 162A via a second extension piston/cylinder unit 106*b* of the fork extension/retraction assembly 106, see FIG. 14A, the direction of the arrow D200 defining a direction of elongation of the first and second fork members 162A, 162B. The second extension piston/cylinder unit 106*b* may be substantially similar to the first extension piston/cylinder unit 106*a*. When the first and second extension piston/cylinder units 106*a* and 106*b* of the fork extension/retraction assembly 106 are actuated so as to extend their pistons, the second fork members 160B and 162B move away from, i.e., extend out from, the fork support 64 and the first fork members 160A and 162A so as to define telescopic or extended forks. Conversely, when the first and second extension piston/cylinder units 106*a* and 106*b* of the fork extension/retraction assembly 106 are actuated so as to retract their pistons, the second fork members 160B and 162B move toward the fork support 64 and the first fork members 160A and 162A.

Figure 6:
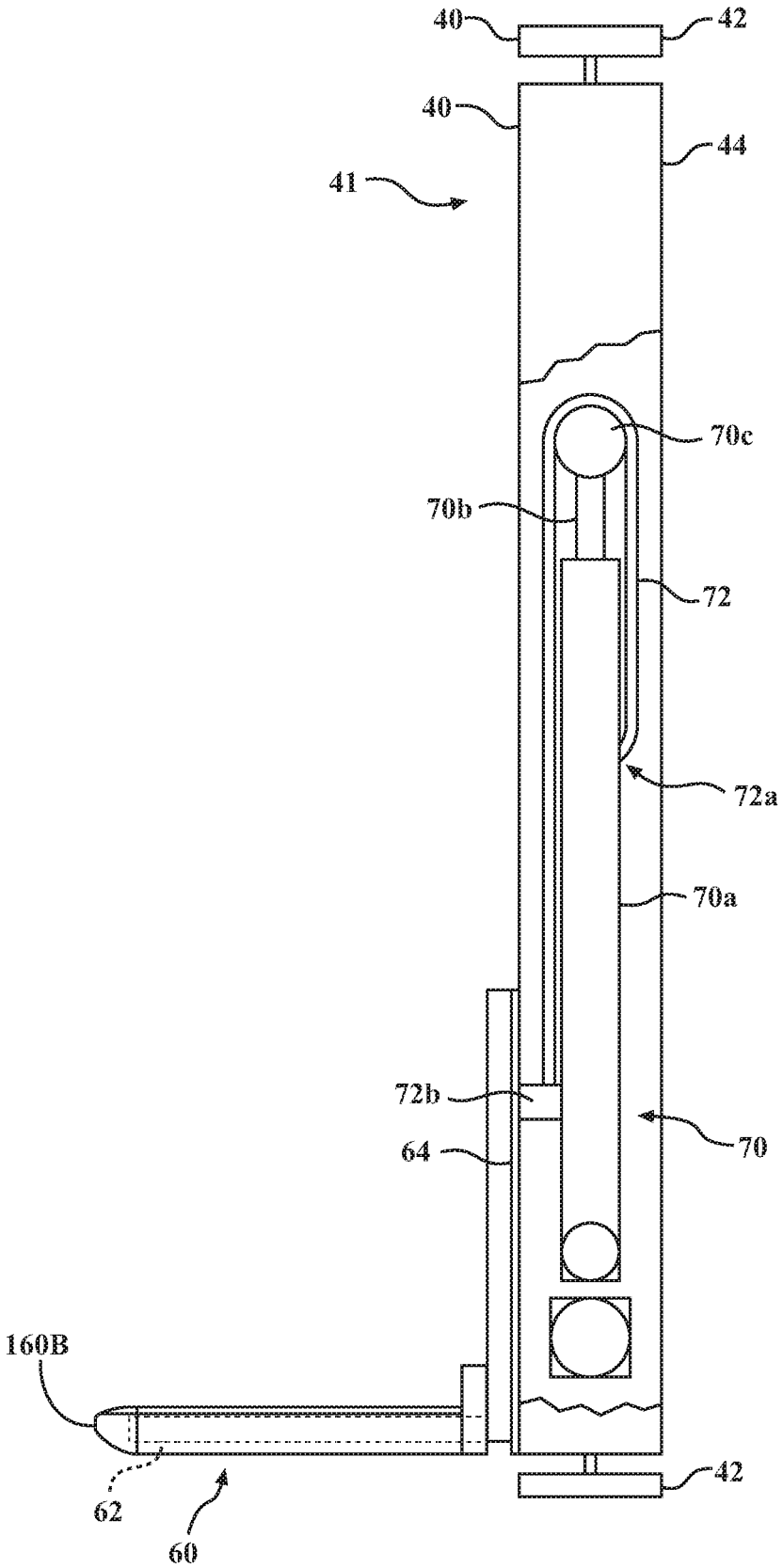
FIG. 6 is a schematic view illustrating the fork carriage assembly lift piston/cylinder unit and electronically controlled valve coupled to the fork carriage assembly lift piston/cylinder unit of the vehicle illustrated in FIG. 1.

A piston/cylinder unit 70 is provided in the second mast structure 44 for effecting vertical movement of the fork carriage assembly 60 relative to the second mast structure 44, see FIG. 6. A cylinder 70*a* forming part of the piston/cylinder unit 70 is fixedly coupled to the second mast structure 44. A piston or ram 70*b* forming part of the unit 70 comprises a pulley 70*c* on its distal end, which engages a chain 72. One unit of vertical movement of the piston 70*b* results in two units of vertical movement of the fork carriage assembly 60. The chain 72 is fixedly coupled at a first end 72*a* to the cylinder 70*a* and fixedly coupled at a second end 72*b* to the fork support 64. The chain 72 extends from the cylinder 70*a*, over the pulley 70*c* and down to the fork support 64. Upward movement of the piston 70*b* effects upward movement of the fork carriage assembly 60 relative to the second mast structure 44, while downward movement of the piston 70*b* effects downward movement of the fork carriage assembly 60 relative to the second mast structure 44.

FIGS. 7-10 illustrate more detailed views of the fork carriage assembly 60, particularly the fork support 64. The fork support 64 comprises a frame 80 having a generally rectangular shape. The frame 80 provides the structural support for the forks 62 via a conventional rod or pin (not shown) that is coupled to the frame 80 at respective fork pivot locations 82A, 82B and extends through fork hanger openings 84A, 84B at the top of each of the forks 62. The forks 62 are pivotably supported to the fork support 64 at the fork pivot locations 82A, 82B, as will be discussed in greater detail herein.

Figure 8:
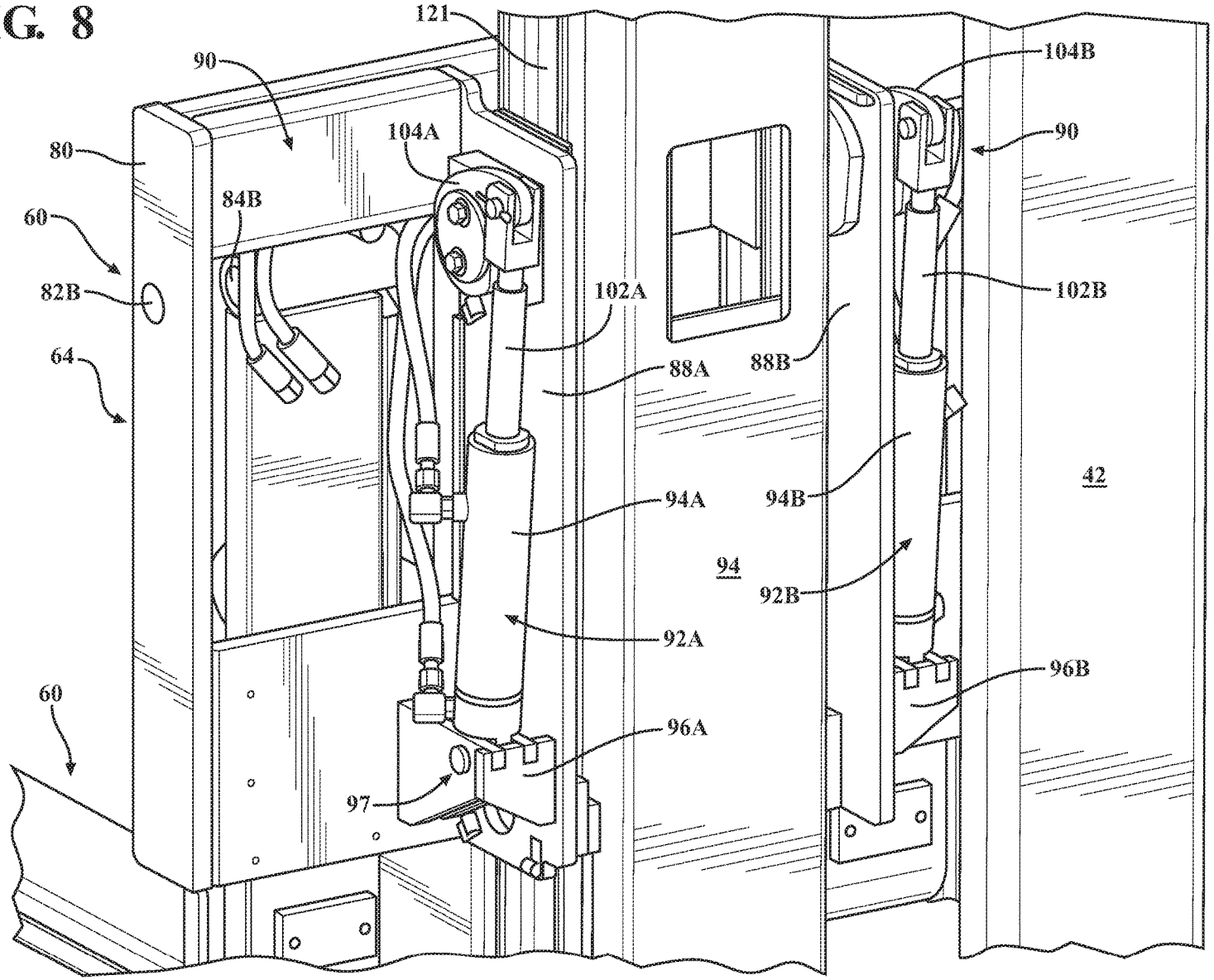
FIG. 8 is a perspective view of a back side of the fork carriage assembly of the vehicle illustrated in FIG. 1.
Figure 9:
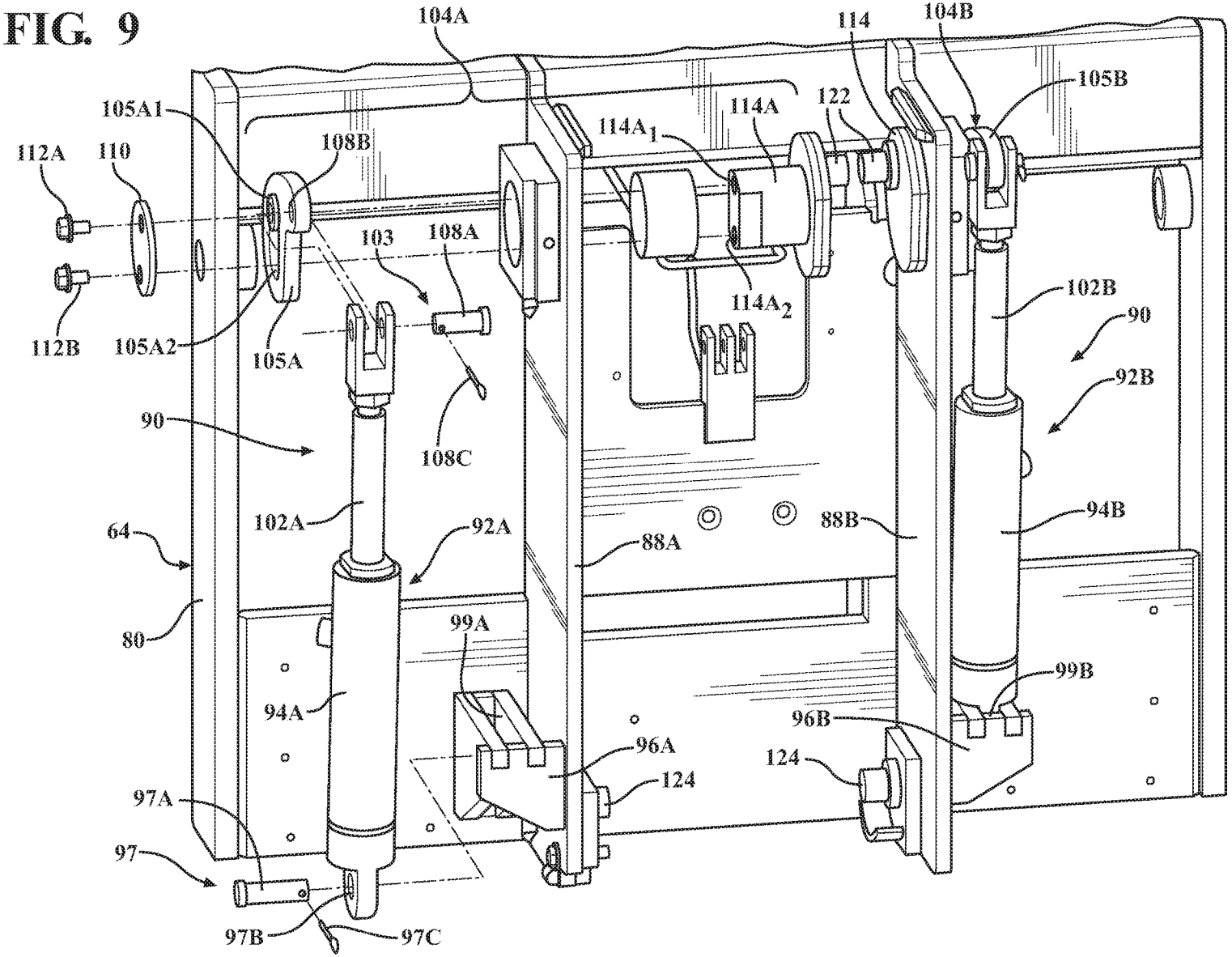
FIG. 9 is a partially exploded perspective view of the back side of the fork carriage assembly of the vehicle illustrated in FIG. 1, with select components removed for clarity.

A backside of the frame 80, illustrated in FIG. 8, includes a pair of generally vertically extending flanges 88A, 88B that extend outwardly from the frame 80 toward the auxiliary mast assembly 41. A tilt assembly 90 is provided for tilting the fork support 64 and the forks 62 relative to the auxiliary mast assembly 41. The tilt assembly 90 comprises first and second tilt cylinder assemblies 92A, 92B, each having a direction of elongation generally in the vertical direction, which vertical direction is perpendicular to a horizontal direction Hz (see FIGS. 12A and 12B), wherein the horizontal direction Hz is defined with respect to the floor surface on which the vehicle 10 is located. First and second cylinders 94A, 94B of the tilt cylinder assemblies 92A, 92B are coupled to mount units 96A, 96B, which are fixed to the frame 80 of the fork support 64 and to the respective flanges 88A, 88B. With reference to FIG. 9, the cylinders 94A, 94B are coupled to the mount units 96A, 96B via first mounting structure 97 (only the first mounting structure 97 for the cylinder 94A is shown in FIG. 9 and will be described herein, it being understood that the first mounting structure 97 for the other cylinder 94B is the same as the described mounting structure 97) that permits the cylinder assemblies 92A, 92B to pivot within slots 99A, 99B formed in the mount units 96A, 96B. The exemplary first mounting structure 97 illustrated in FIG. 9 comprises a pin 97A, e.g., a clevis pin, that extends through opposing bores formed in the mount unit 96A adjacent to the slot 99A and is received in an opening 97B within the first cylinder 94A. The pin 97A may be fixed in place with a cotter pin 97C as shown in FIG. 9. It is understood that other suitable types of mounting structures can be used for pivotably supporting the cylinder assemblies 92A, 92B to the mount units 96A, 96B.

First and second pistons or rams 102A, 102B of the tilt cylinder assemblies 92A, 92B are coupled to respective first and second cam assemblies 104A, 104B that are rotatable with respect to the flanges 88A, 88B. Referring still to FIG. 9, the cam assemblies 104A, 104B each include a cam lever arm 105A, 105B, which are pivotably coupled to the respective rams 102A, 102B via second mounting structure 103 (only the second mounting structure 103 for the first cam assembly 104A is shown in FIG. 9 and will be described herein, it being understood that the second mounting structure 103 for the second cam assembly 104B is the same as the described mounting structure 103). The exemplary second mounting structure 103 illustrated in FIG. 9 comprises a pin 108A, e.g., a clevis pin, that extends through opposing bores formed in the mount unit ram 102A and is received in an opening 108B within the cam lever arm 105A. The pin 108A may be fixed in place with a cotter pin 108C as shown in FIG. 9. It is understood that other suitable types of mounting structures can be used for pivotably supporting the rams 102A, 102B to the cam lever arms 105A, 105B.

The first cam assembly 104A will now be described, it being understood that the second cam assembly 104B is the same as the described first cam assembly 104A. The cam assembly 104A comprises a keeper plate 110 that is bolted to the cam lever arm 105A via bolts 112A, 112B. The keeper plate 110 prevents dirt/debris from entering the cam assembly 104A and couples the cam lever arm 105A to a cam weldment 114, i.e., the bolts 112A, 112B respectively extend through a spacer/washer structure 105A1, which is assembled onto the pin 108A, and a bore 105A2 formed in the cam lever arm 105A, 105B and are threaded into threaded openings 114$A_1$, 114$A_2$ formed in the cam weldment 114A. The cam weldments 114 are coupled to respective cam rollers 120 (see FIGS. 12A and 12B) that move in a generally vertical direction within channels 121 defined by the second mast structure 44 of the auxiliary mast assembly 41. Movement of the cam assemblies 104A, 104B and the cam rollers 120 causes tilting of the fork support 64 and the forks 62 relative to the auxiliary mast assembly 41. Specifically, a roller stud 122 of the cam weldment 114, upon which roller stud 122 the cam roller 120 is supported, is not concentric with the bearing surface of the cam weldment 114. Thus, when the tilt cylinder assembly 92A is actuated to cause the ram 102A to extend or retract to thereby drive rotation of the cam lever arm 105A and the cam weldment 114, the roller stud 122 moves with an arc-like movement corresponding to the rotation of the cam weldment 114. This arc-like movement causes the frame 80 of the fork support 64 and the forks 62 to tilt relative to the auxiliary mast assembly 41 such that a central axis $C_A$ (see FIGS. 12A, 12B, and 13) of each of the fork assemblies 160, 162 is positionable in a plurality of different positions relative to the horizontal direction Hz, as will be described in greater detail below. More specifically, the arc-like movement of the roller stud 122 effectively pushes the top of the frame 80 of the fork support 64 toward/away from the auxiliary mast assembly 41 when the first and second cylinders 94A, 94B of the tilt cylinder assemblies 92A, 92B are extended/retracted, i.e., the frame 80 of the fork support 64 pivots toward/away from the auxiliary mast assembly 41 at a pivot point defined by lower carriage/mast roller studs 124 coupled to the flanges 88A, 88B.

Figure 7:
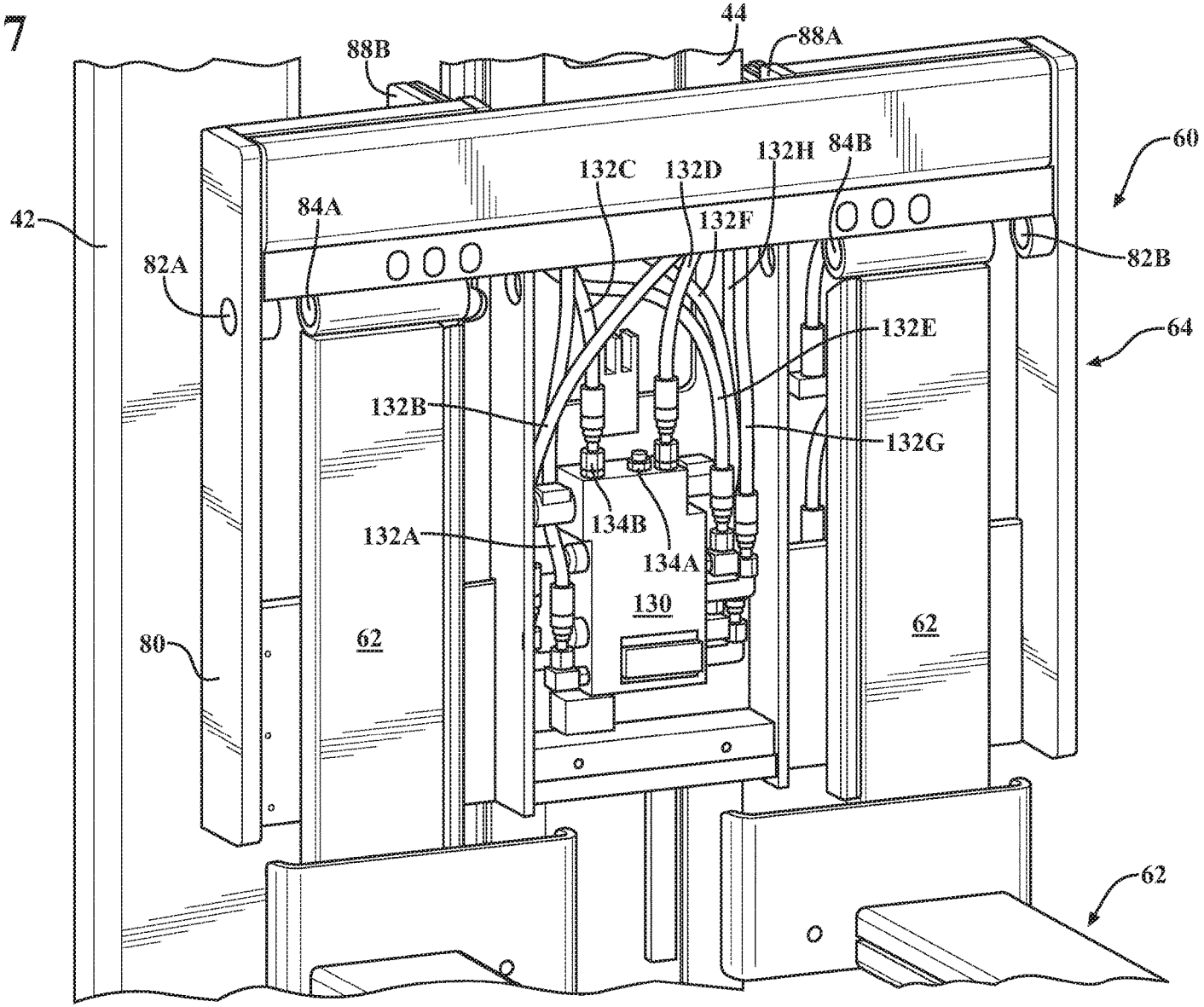
FIG. 7 is a perspective view of a front side of the fork carriage assembly of the vehicle illustrated in FIG. 1.

A manifold 130, illustrated in FIG. 7, is provided to supply hydraulic fluid to the first and second extension piston/cylinder units 106*a*, 106*b* of the fork extension/retraction assembly 106 and to the first and second tilt cylinder assemblies 92A, 92B of the tilt assembly 90 via flow path defining conduits or hoses, hereinafter referred to as "hydraulic hoses". In the exemplary manifold shown in FIG. 7: a first hydraulic hose 132A provides hydraulic fluid to the first extension piston/cylinder unit 106*a* during a fork extend operation; a second hydraulic hose 132B provides hydraulic fluid to the second extension piston/cylinder unit 106*b* during a fork extend operation; a third hydraulic hose 132C provides hydraulic fluid to the second tilt cylinder assembly 92B during a tilt retract operation; a fourth hydraulic hose 132D provides hydraulic fluid to the first tilt cylinder assembly 92A during a tilt retract operation; a fifth hydraulic hose 132E provides hydraulic fluid to the second tilt cylinder assembly 92B during a tilt extend operation; a sixth hydraulic hose 132F provides hydraulic fluid to the first extension piston/cylinder unit 106*a* during a fork retract operation; a seventh hydraulic hose 132G provides hydraulic fluid to the first tilt cylinder assembly 92A during a tilt extend operation; and an eighth hydraulic hose 132H provides hydraulic fluid to the second extension piston/cylinder unit 106*b* during a fork retract operation. Additional ports 134A, 134B are provided in the manifold for main hydraulic fluid supply and return to a hydraulic fluid source (not shown) located on the vehicle 10. It is understood that other manifold configurations could be used, including using separate manifolds for one or more of the piston/cylinder units 106*a*, 106*b* and/or tilt cylinder assemblies 92A, 92B.

Figure 10:
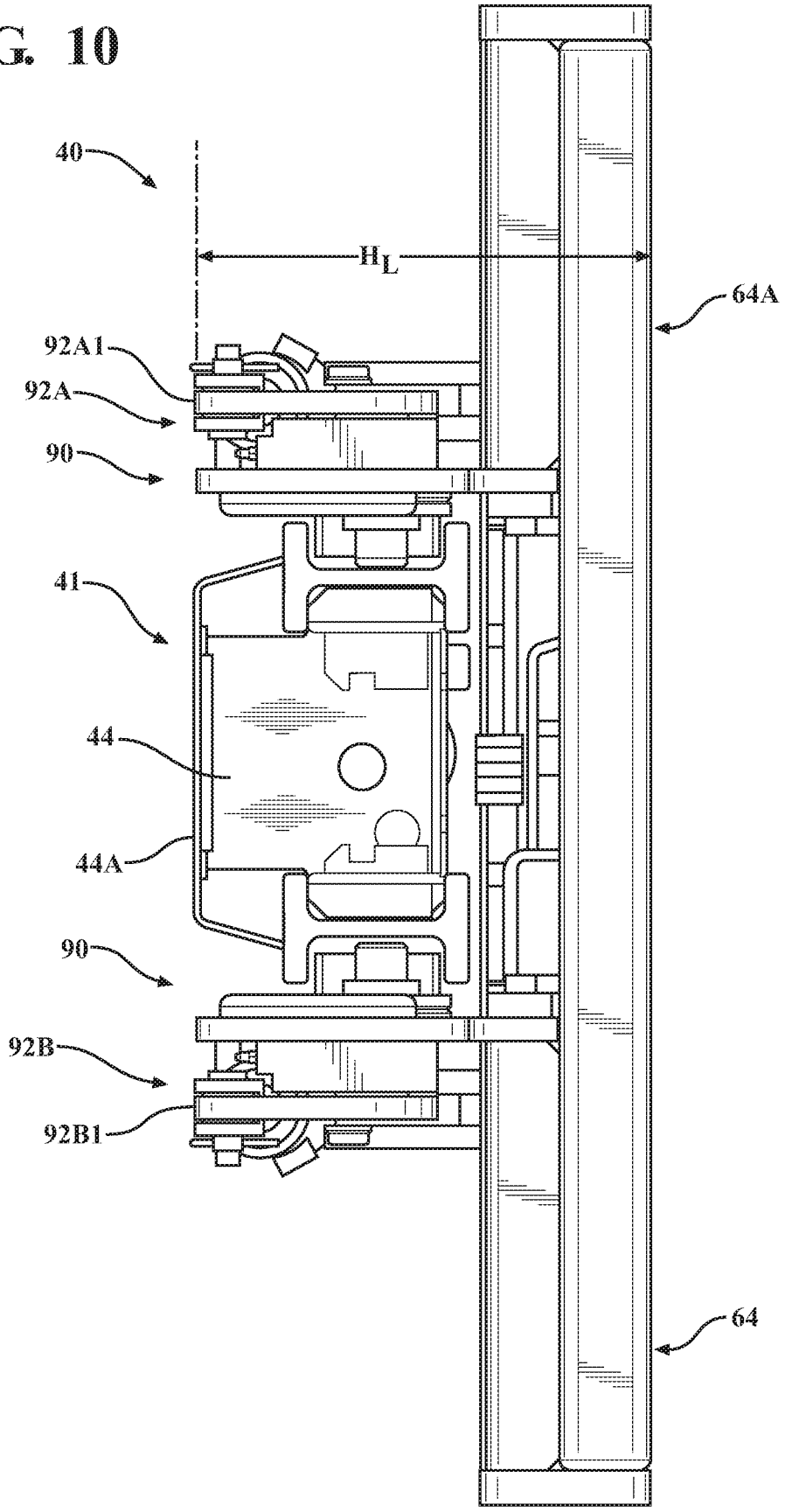
FIG. 10 is a top view of the fork carriage assembly of the vehicle illustrated in FIG. 1.

With reference to FIG. 10, a headlength HL of the load handling assembly 40, which headlength HL is defined as a length from an outer surface 64A of the fork support 64, i.e., a surface of the fork support 64 opposite to the second mast structure 44 of the auxiliary mast assembly 41, to a surface of the tilt assembly 90, i.e., an inner surface 92A1, 92B1 of the tilt cylinder assemblies 92A, 92B is less than about ten (10) inches and may be about 9.5 to about 9.75 inches. The inner surface 92A1, 92B1 of the tilt cylinder assemblies 92A, 92B may generally coincide with an inner surface 44A of the second mast structure 44 of the auxiliary mast assembly 41, i.e., a surface of the auxiliary mast assembly 41 opposite to the fork support 64, and an inner surface of the flanges 88A, 88B. The headlength HL encompasses the fork support 64, the second mast structure 44 of the auxiliary mast assembly 41, the tilt cylinder assemblies 92A, 92B, the flanges 88A, 88B, and the manifold 130, i.e., all of these structures are located within the headlength HL. The headlength HL of the load handling assembly 40 according to the present embodiment is believed to be significantly less than headlengths of prior art load handling assemblies that utilize different assemblies for effecting tilting of the fork support and forks.

Figure 12A:
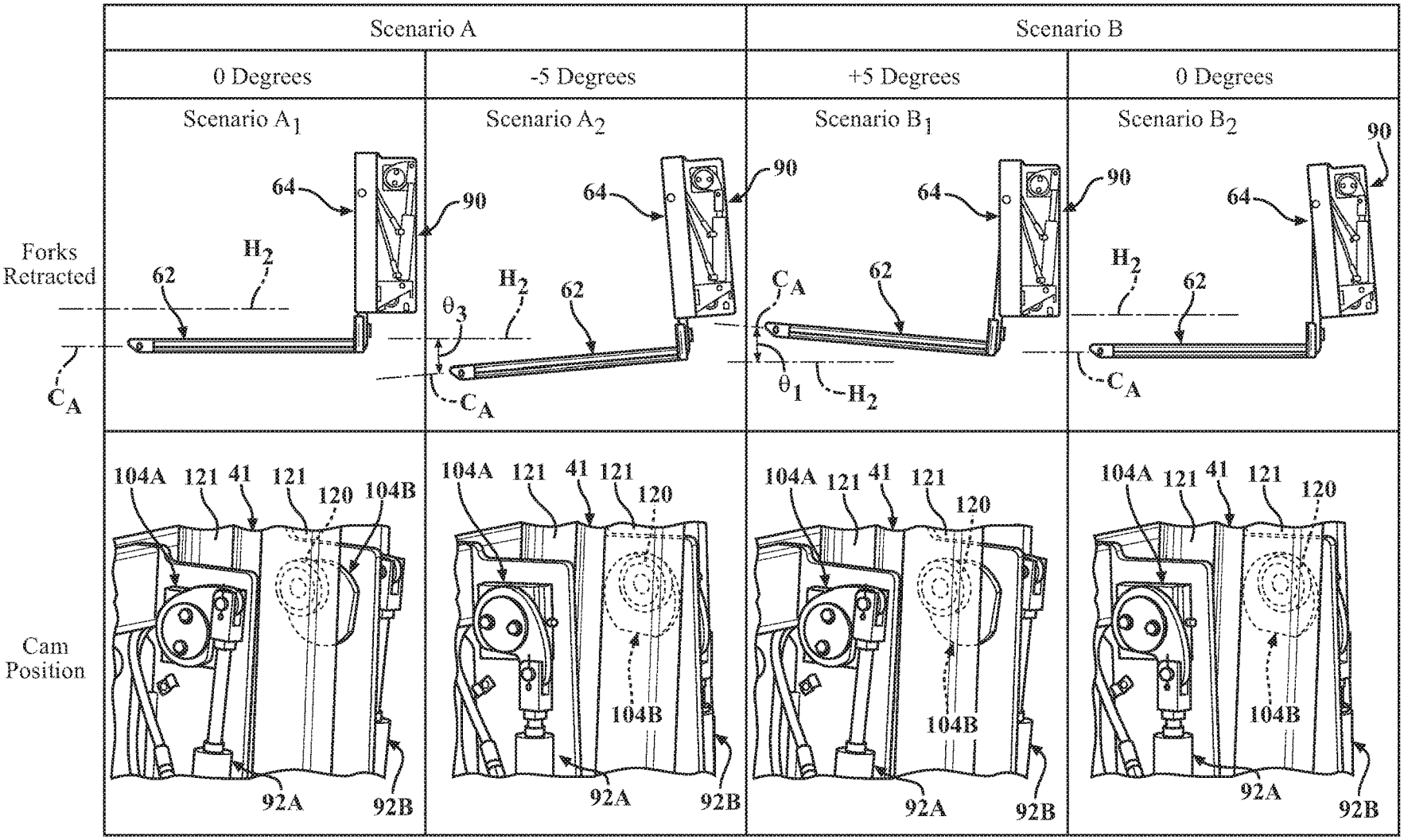
FIGS. 12A and 12B are views illustrating exemplary positions of select components of the vehicle illustrated in FIG. 1.
Figure 12B:
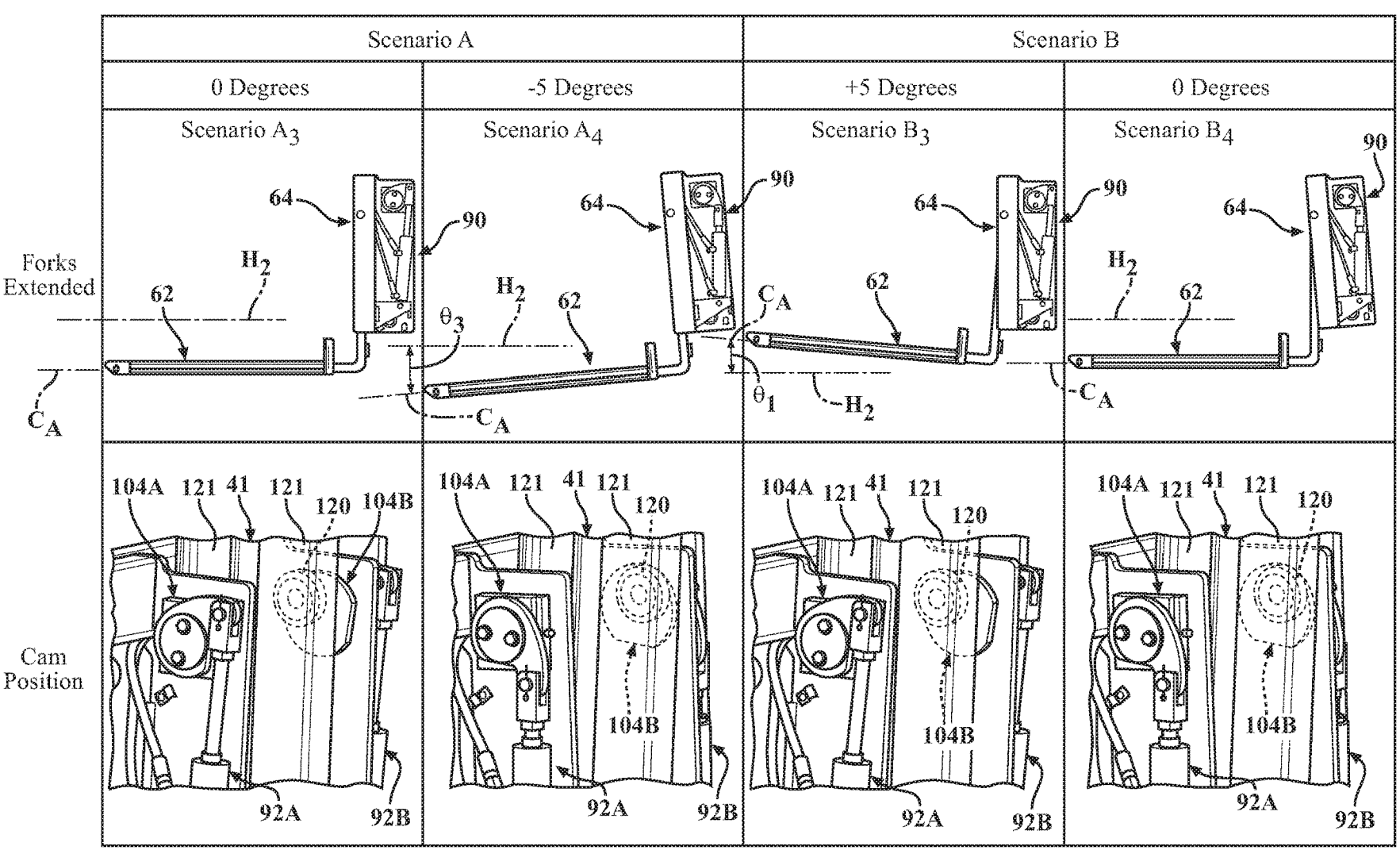

Turning now to FIGS. 12A and 12B, select positions of the fork support 64 and forks 62, along with the corresponding positions of the tilt cylinder assemblies 92A, 92B, cam assemblies 104A, 104B, and cam rollers 120 are shown. It is understood that the positions shown in FIGS. 12A and 12B are exemplary and are meant to show select ones of many possible positions.

Initially, it is noted that scenario A corresponds to a configuration wherein a first spacer structure $SP_1$ (see FIG. 13) is provided to set a "home" position of the fork support 64 and forks 62 such that the central axis $C_A$ of each of the fork assemblies 160, 162 is generally parallel to the horizontal direction Hz. Scenario B corresponds to a configuration wherein a second spacer structure $SP_2$ (see FIG. 13) is provided to set a "home" position of the fork support 64 and forks 62 such that the central axis $C_A$ of each of the fork assemblies 160, 162 is set at a predetermined positive first angle $\theta_1$ relative to the horizontal direction Hz, wherein the first angle $\theta_1$ may be, for example, about 5 degrees. Scenario C, shown only in FIG. 13, corresponds to a configuration wherein a third spacer structure $SP_3$ is provided to set a "home" position of the fork support 64 and forks 62 such that the central axis $C_A$ of each of the fork assemblies 160, 162 is set at a predetermined positive second angle $\theta_2$ relative to the horizontal direction Hz, wherein the second angle $\theta_2$ may be less than the first angle $\theta_1$, for example, about 2.5 degrees. The "home" position is defined by a position of the fork support 64 wherein the outer surface 64A thereof is generally perpendicular to the horizontal direction Hz.

Scenario $A_1$ illustrated in FIG. 12A represents the home position of the fork support 64 and forks 62 with the first spacer structure $SP_1$, wherein the central axis $C_A$ of each of the fork assemblies 160, 162 is generally parallel to the horizontal direction Hz. The forks 62 are provided in a retracted position in scenario $A_1$, wherein the piston of the first and second extension piston/cylinder units 106*a* and 106*b* of the fork extension/retraction assembly 106 are in their retracted positions such that the second fork members 160B and 162B are located in close proximity to the fork support 64. The scenario $A_2$ illustrated in FIG. 12A represents a "tilt" position of the fork support 64 and forks 62 with the first spacer structure $SP_1$, wherein the central axis $C_A$ of each of the fork assemblies 160, 162 is positioned at a third angle $\theta_3$ relative to the horizontal direction Hz. The third angle $\theta_3$ may be, for example, about −5 degrees. The forks 62 are provided in the retracted position in scenario $A_2$.

Scenario $B_1$ illustrated in FIG. 12A represents the home position of the fork support 64 and forks 62 with the second spacer structure $SP_2$, wherein the central axis $C_A$ of each of the fork assemblies 160, 162 is set at the first angle $\theta_1$ relative to the horizontal direction Hz. The forks 62 are provided in the retracted position in scenario $B_1$. The scenario $B_2$ illustrated in FIG. 12A represents the tilt position of the fork support 64 and forks 62 with the second spacer structure $SP_2$, wherein the central axis $C_A$ of each of the fork assemblies 160, 162 is generally parallel to the horizontal direction Hz. The forks 62 are provided in the retracted position in scenario $B_2$.

Scenario $A_3$ illustrated in FIG. 12B represents the home position of the fork support 64 and forks 62 with the first spacer structure $SP_1$, wherein the central axis $C_A$ of each of the fork assemblies 160, 162 is generally parallel to the horizontal direction Hz. The forks 62 are provided in an extended position in scenario $A_3$, wherein the piston of the first and second extension piston/cylinder units 106*a* and 106*b* of the fork extension/retraction assembly 106 are in their extended positions such that the second fork members 160B and 162B are spaced from the fork support 64, e.g., by about 3 inches, about 7.5 inches, or up to about 12 inches as desired. The scenario $A_4$ illustrated in FIG. 12B represents the tilt position of the fork support 64 and forks 62 with the first spacer structure $SP_1$, wherein the central axis $C_A$ of each of the fork assemblies 160, 162 is positioned at the third angle $\theta_3$ relative to the horizontal direction Hz. The forks 62 are provided in the extended position in scenario $A_4$.

Scenario $B_3$ illustrated in FIG. 12B represents the home position of the fork support 64 and forks 62 with the second spacer structure $SP_2$, wherein the central axis $C_A$ of each of the fork assemblies 160, 162 is set at the first angle $\theta_1$ relative to the horizontal direction Hz. The forks 62 are provided in the extended position in scenario $B_3$. The scenario $B_4$ illustrated in FIG. 12B represents the tilted position of the fork support 64 and forks 62 with the second spacer structure $SP_2$, wherein the central axis $C_A$ of each of the fork assemblies 160, 162 is generally parallel to the horizontal direction Hz. The forks 62 are provided in the extended position in scenario $B_4$.

Figure 13:
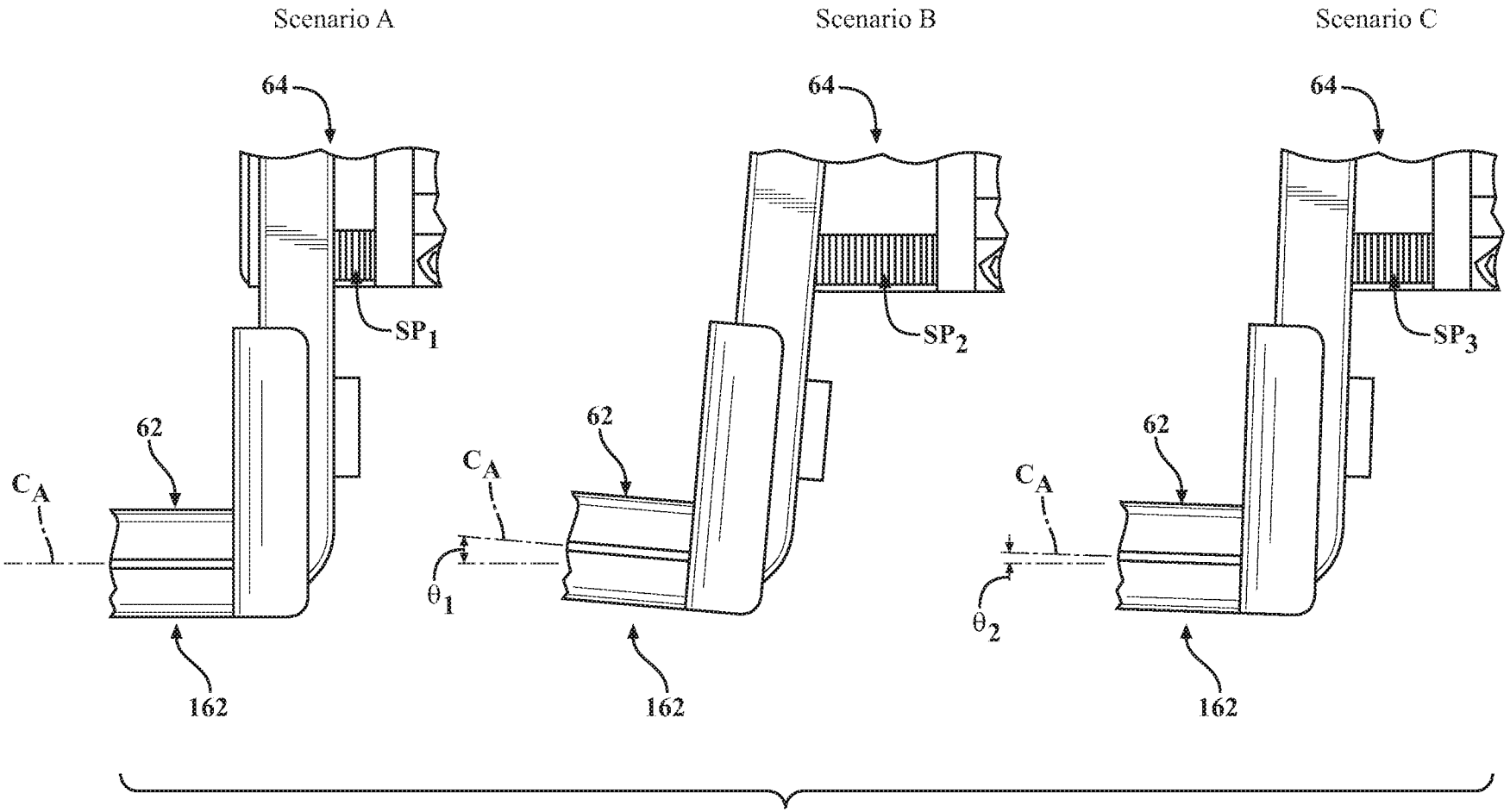
FIG. 13 is an additional view illustrating exemplary positions of select components of the vehicle illustrated in FIG. 1.

Scenario C shown in FIG. 13 is provided to illustrate another exemplary spacer structure $SP_3$ to define a home position of the fork support 64 and forks 62 at an additional angle relative to the horizontal direction Hz.

Figure 14A:
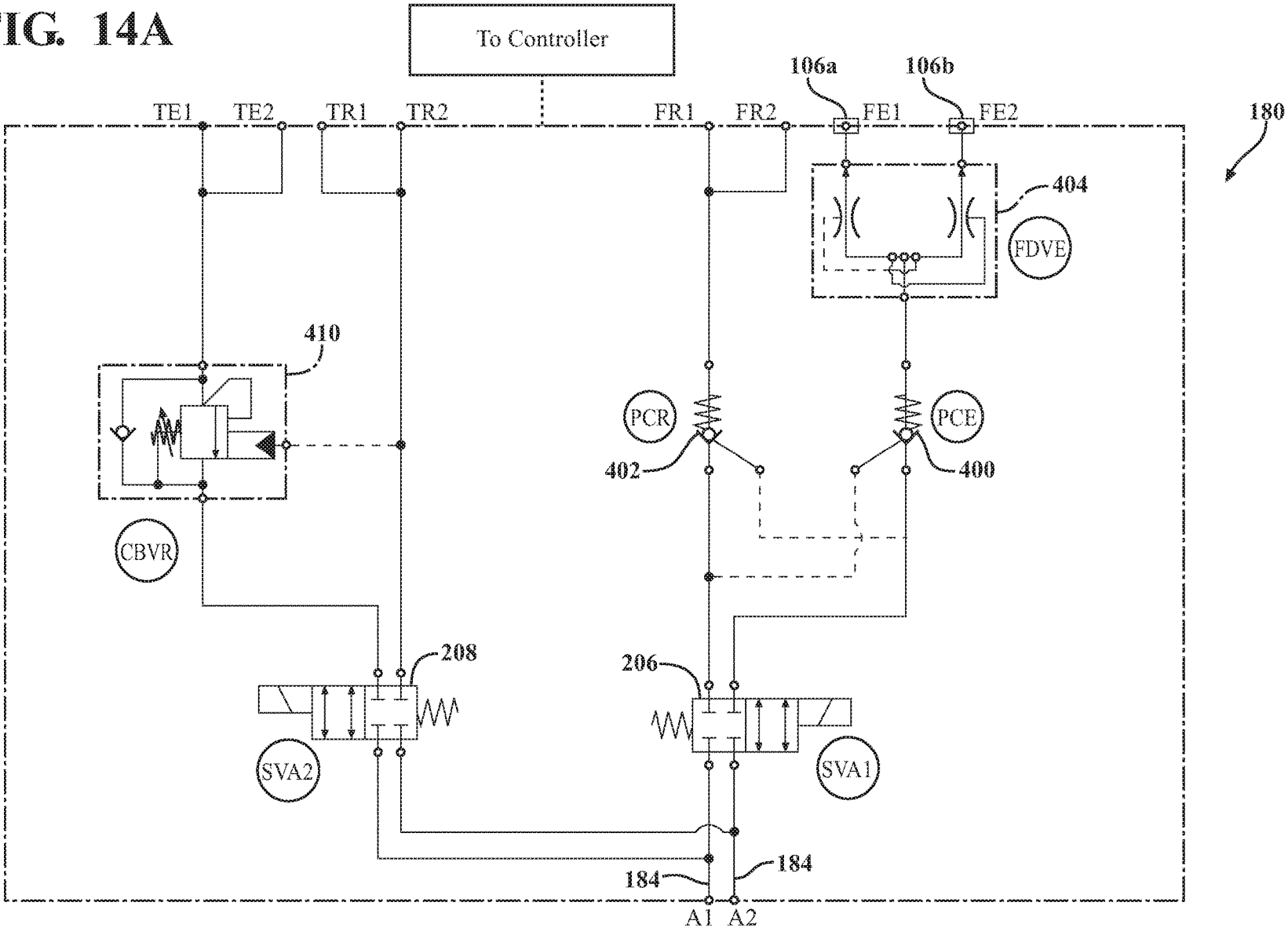
FIG. 14A illustrates a schematic diagram of a portion of the hydraulic circuit of FIG. 14.

A schematic diagram of a hydraulic circuit 180 of the vehicle 10 is illustrated in FIGS. 14 and 14A. The hydraulic circuit 180 in the embodiment shown comprises a manifold 182, which may be located in an upper portion 42A of the first mast structure 42 of the load handling assembly 40, see FIG. 2.

Hydraulic hoses 184 enable working fluid communication between the valves and pumps, cylinders, and motors associated with the hydraulic circuit 180. Provided in the manifold 182 are a plurality of mechanical and electronically controlled valves that receive the working fluid, e.g., a pressurized hydraulic oil, during normal operation of the vehicle 10, e.g., when the components of the vehicle are fully operational. The electronically controlled valves of the manifold 182 may comprise electronically controlled solenoid-operated proportional valves, coupled to and actuated by a controller 210 in response to operator generated commands via first and second multi-function controllers 220A and 220B (see FIGS. 1 and 2), and are provided for implementing various vehicle functions associated with the respective valve.

Exemplary valves in the illustrated manifold 182 include an auxiliary lower valve 190 that controls the flow of the working fluid out of the auxiliary hoist piston/cylinder unit 70 when a lowering command is being implemented; an auxiliary raise valve 194 that controls the flow of the working fluid into the auxiliary hoist piston/cylinder unit 70 when a raise command is being implemented; a traverse valve 196 that controls the flow of the working fluid to and/or from the traverse hydraulic motor 98 when a traverse command is being implemented; a pivot valve 200 that controls the flow of the working fluid to and/or from the first and second pivot piston/cylinder units 102*a*, 102*b* when a pivot command is being implemented; an extend valve 206 (see FIG. 14A) that controls the flow of the working fluid to and/or from the first and second extension piston/cylinder units 106*a* and 106*b* when a second/fourth fork member extension/retraction command is being implemented; a tilt control valve 208 (see FIG. 14A) that controls the flow of the working fluid to and/or from the first and second tilt cylinder assemblies 92A, 92B when a tilt command is being implemented; and a fork function valve 212 that controls fork function (tilt or extend) speed and direction. A load handler valve 204 is also provided in the manifold 182. The load handler valve 204 controls a pressure level within the hydraulic manifold 182 such that the hydraulic fluid pressure downstream from the load handler valve 204 is at a sufficient level for proper operation of a selected one or more of the electronically controlled solenoid valves 194, 196, 200, 206, 212.

In the illustrated embodiment, the auxiliary lower valve 190 may comprise a solenoid-operated, two-way, normally closed, proportional directional valve; the auxiliary raise valve 194 may comprise a solenoid-operated, two-way, normally closed, proportional directional valve; the traverse valve 196 may comprise a solenoid-operated, 5-way, 3-position, proportional directional, load sensing valve; the pivot valve 200 may comprise a solenoid-operated, 5-way, 3-position, proportional directional, load sensing valve; the load handler valve 204 may comprise a solenoid-operated, proportional pressure control relief valve; the fork function valve 212 may comprise a 4-way, 3-position proportional valve.

The hydraulic circuit 180 comprises other electronically controlled solenoid-operated valves mounted in the power unit 20. For example, an electronically controlled solenoid-operated non-proportional valve 270 is provided for blocking fluid flow out of the mast piston/cylinder unit 50 until the valve 270 is energized. An electronically controlled solenoid-operated non-proportional valve 271 is provided for blocking working fluid to the mast piston/cylinder unit 50 when not energized and allows fluid flow to the mast piston/cylinder unit 50 when the valve 271 is energized. An electronically controlled solenoid-operated non-proportional valve 272 is provided for blocking working fluid flow to the manifold 182 if working fluid is being provided to or exiting the mast piston/cylinder unit 50 and allows working fluid flow to the manifold 182 when the valve 272 is energized. An electronically controlled solenoid-operated proportional valve 274 is provided and functions as a load holding valve for the mast piston/cylinder unit 50 and must be energized when the mast piston/cylinder unit 50 is lowered such that the working fluid flows through the valve 274 back through a pump 310.

An electronically controlled solenoid-operated, normally closed, non-proportional valve 171 is coupled to a base of the cylinder 70*a* of the auxiliary hoist piston/cylinder unit 70 and is energized by the controller 210 during a controlled descent of the piston 70*b* of the unit 70.

In accordance with embodiments and with reference to FIG. 14A, the hydraulic circuit 180 further comprises fork extend and retract check valves 400, 402 in communication with the extend control valve 206. A flow divider valve 404 is in communication with the fork extend check valve 400 to limit the flow of hydraulic fluid to the first and second extension piston/cylinder units 106*a*, 106*b* of the fork extension/retraction assembly 106. The flow divider valve 404 is intended to provide a 1:1 flow volume to the first and second extension piston/cylinder units 106*a*, 106*b*.

The hydraulic circuit 180 additionally comprises a counterbalance retract valve 410 in communication with the tilt control valve 208. When a load is present on the forks 62 (or just the weight of the forks 62 themselves), the fork support 64 will want to tilt down, rolling the cam weldments 114 backwards, and thus causing the cam lever arms 105A, 105B to push the tilt cylinder assemblies 92A, 92B in to their retracted position, which causes a load-induced pressure within the tilt cylinder assemblies 92A, 92B. The counterbalance retract valve 410 is provided to help to prevent drift of the fork support 64 and also has a feedback port that requires back pressure within the hydraulic circuit 180 so that the forks 62 do not quickly drop when a fork lower command is given. Pressure has to be given to the back side of the counterbalance retract valve 410 before it will open and allow flow therethrough.

Figure 15A:
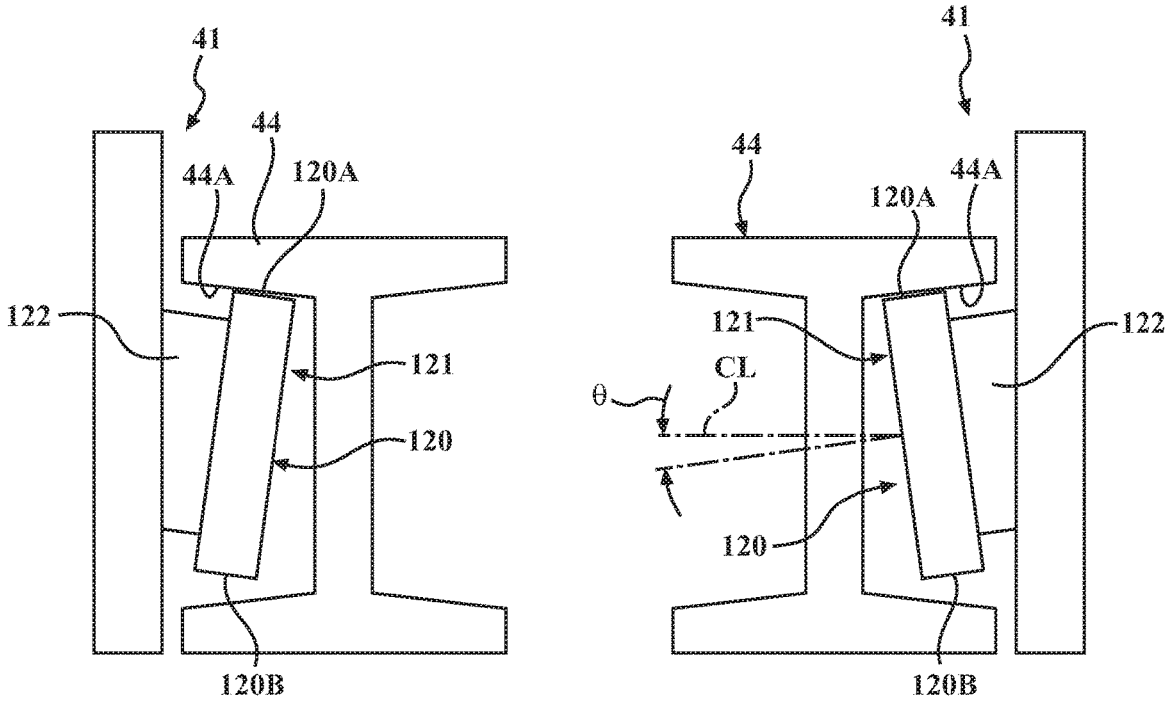
FIGS. 15A and 15B respectively illustrate top views of cam rollers and roller studs of the vehicle illustrated in FIG. 1 according to embodiments.
Figure 15B:
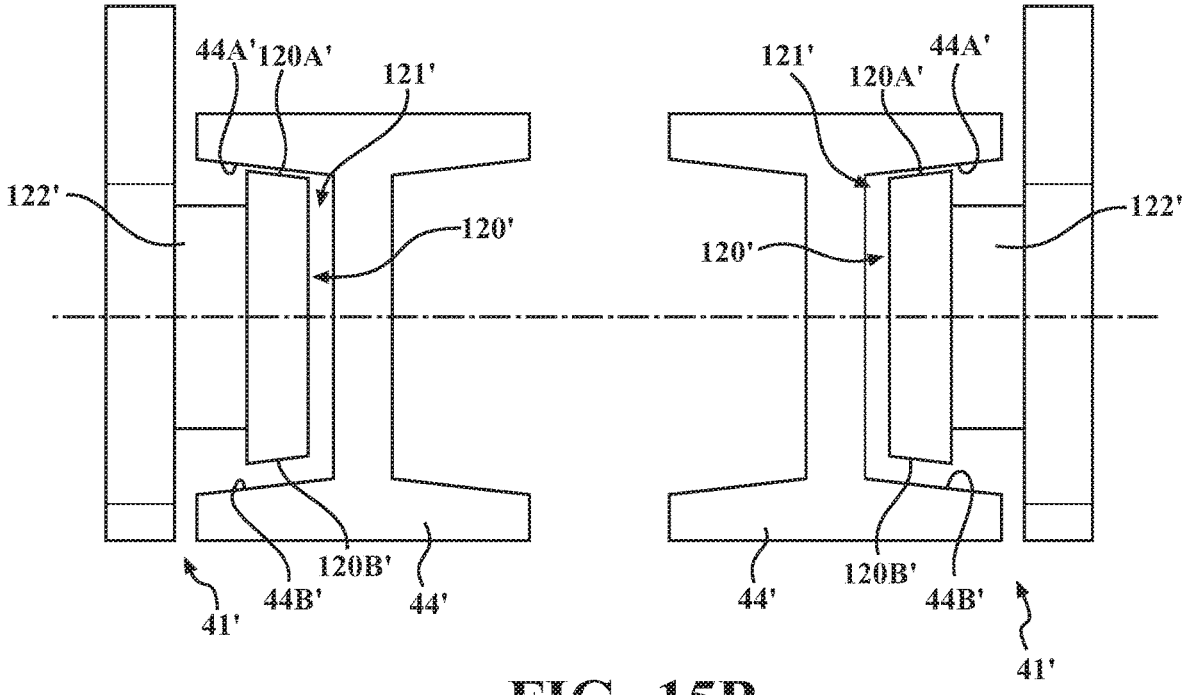

With reference to FIGS. 15A and 15B, two exemplary configurations for a pair of cam rollers 120, 120' and roller studs 122, 122' are respectively shown from above. The cam rollers 120, 120' and roller studs 122, 122' are located in respective channels 121, 121' defined by the second mast structures 44, 44' of the corresponding auxiliary mast assemblies 41, 41'.

With reference to FIG. 15A, the cam rollers 120 are cylindrical in shape, having first and second side edges 120A, 120B that are respectively generally parallel to one another. The roller studs 122 and the cam rollers 120 supported thereon may be oriented at an angle θ relative to a centerline CL extending between the spaced apart cam rollers 120, such that one of the side edges 120A of each cam roller 120 is generally flush with an inner surface 44A of the respective second mast structures 44 that define the corresponding channels 121. The angle θ may be less than about 5 degrees.

Turning now to FIG. 15B, the roller studs 122' and the cam rollers 120' supported thereon according to this embodiment may be generally parallel to a centerline CL extending between the spaced apart cam rollers 120. The cam rollers 120' illustrated in FIG. 15B are conical in shape, having first and second side edges 120A', 120B' that taper inwardly as the cam rollers 120' extend toward one another, such that the first and second side edges 120A', 120B' of the cam rollers 120' generally correspond to the shape of tapered inner surfaces 44A', 44B' of the respective second mast structures 44' that define the corresponding channels 121'. The conical shape of the cam rollers 120' shown in FIG. 15B may allow for more surface contact between the cam rollers 120' and the mast structure 44', resulting in smoother movement of the cam rollers 120' within the channels 121'.

The embodiments disclosed herein may be incorporated into other materials handling vehicles, and are not limited to the turret truck illustrated in the drawings. Further, the various features, aspects, and embodiments described herein can be used in any combination(s) with one another, or on their own.

Having thus described embodiments in detail, it will be apparent that modifications and variations are possible without departing from the scope of the appended claims.

What is claimed is:

1. A materials handling vehicle comprising:

a load handling assembly including a mast assembly comprising a vertical first mast structure and a vertical second mast structure;

a fork carriage assembly comprising a fork support and at least one fork assembly, the at least one fork assembly including a first fork member, which is fixed to the fork support, and a second fork member;

a tilt assembly that tilts the fork support relative to the mast assembly such that a central axis of the at least one fork assembly is positionable in a plurality of different positions relative to a horizontal direction, the horizontal direction defined with respect to a floor surface on which the vehicle is located, the tilt assembly including at least one tilt cylinder assembly; and a fork extension/retraction assembly that moves the second fork member relative to the first fork member in a first direction that is parallel to the central axis of the at least one fork assembly such that the fork extension/retraction assembly selectively moves the second fork member toward or away from the fork support in the first direction;

wherein an inner surface of the tilt cylinder assembly coincides with an inner surface of the second mast structure in a second direction along at least 50% of a height of the tilt cylinder assembly, the second direction being perpendicular to the longitudinal axis of the fork support.

2. The materials handling vehicle according to claim 1, wherein the at least one tilt cylinder assembly includes a cylinder and a piston.

3. The materials handling vehicle according to claim 2, wherein extension of the piston causes the tilt assembly to tilt the fork support relative to the mast assembly such that the fork support and the at least one fork assembly move into a tilt position, and a subsequent retraction of the piston causes the tilt assembly to tilt the fork support relative to the mast assembly such that the fork support and the at least one fork assembly move into a home position.

4. The materials handling vehicle according to claim 1, wherein the at least one tilt cylinder assembly has direction of elongation in the vertical direction.

5. The materials handling vehicle according to claim 2, further comprising at least one cam assembly coupled to a corresponding tilt cylinder assembly, the cam assembly driven by the piston of the tilt cylinder assembly to tilt the fork support relative to the mast assembly.

6. The materials handling vehicle according to claim 5, wherein the cam assembly comprises a cam weldment including a roller stud that is not concentric with a bearing surface of the cam weldment.

7. The materials handling vehicle according to claim 6, wherein rotation of the cam weldment causes the roller stud to move with an arc-like movement corresponding to the rotation of the cam weldment, wherein the arc-like movement tilts the fork support relative to the mast assembly.

8. The materials handling vehicle according to claim 1, wherein the fork support is tiltable by the tilt assembly such that the central axis of the at least one fork assembly is positionable up to plus (+) or minus (−) 5 degrees relative to the horizontal direction.

9. The materials handling vehicle according to claim 1, further comprising a spacer structure that sets the central axis of the at least one fork assembly at a predetermined angle relative to the horizontal direction.

10. The materials handling vehicle according to claim 1, wherein the vehicle comprises two fork assemblies.

11. The materials handling vehicle according to claim 1, wherein the second fork member is positioned over the first fork member.

12. The materials handling vehicle according to claim 1, wherein a headlength of the load handling assembly, which headlength is defined as a length from an outer surface of the fork support opposite to the mast assembly, to an inner surface of the tilt assembly, is less than ten (10) inches.

13. The materials handling vehicle according to claim 1, wherein the second mast structure is rotatable relative to the first mast structure.

14. The materials handling vehicle according to claim 12, wherein the headlength encompasses the fork support, the second mast structure, and the tilt assembly.

15. The materials handling vehicle according to claim 12, wherein the at least one tilt cylinder assembly includes a cylinder and a piston, the cylinder mounted to a flange that extends outwardly from the fork support toward the mast assembly.

16. The materials handling vehicle according to claim 15, wherein the headlength further encompasses the at least one tilt cylinder assembly and the flange.

17. The materials handling vehicle according to claim 16, wherein the headlength further encompasses a manifold that supplies hydraulic fluid to both the fork extension/retraction assembly and the tilt assembly.

18. The materials handling vehicle according to claim 1, further comprising a manifold that supplies hydraulic fluid to both the fork extension/retraction assembly and the tilt assembly.

19. The materials handling vehicle according to claim 18, wherein the manifold supplies the hydraulic fluid to both the fork extension/retraction assembly and the tilt assembly via respective hydraulic hoses.

20. A materials handling vehicle comprising:

a power unit;

a platform including an operator compartment;

a load handling assembly including an auxiliary mast assembly comprising a vertical first mast structure and a vertical second mast structure;

a main mast assembly that moves the platform and load handling assembly relative to the power unit;

a fork carriage assembly comprising a fork support and first and second fork assemblies, each of the first and second fork assemblies including a first fork member, which is fixed to the fork support, and a second fork member;

a tilt assembly that tilts the fork support relative to the mast assembly such that a central axis of first and second fork assemblies is positionable in a plurality of different positions relative to a horizontal direction, the horizontal direction defined with respect to a floor surface on which the vehicle is located, the tilt assembly including at least one tilt cylinder assembly; and a fork extension/retraction assembly that moves the second fork member of each fork assembly relative to the first fork member in a first direction that is parallel to the central axis of the first and second fork assemblies such that the fork extension/retraction assembly selectively moves the second fork members toward or away from the fork support in the first direction;

wherein an inner surface of the tilt cylinder assembly coincides with an inner surface of the second mast structure of the auxiliary mast structure in a second direction along at least 50% of a height of the tilt cylinder assembly, the second direction being perpendicular to the longitudinal axis of the fork support.

21. The materials handling vehicle according to claim 20, wherein the tilt assembly comprises first and second tilt cylinder assemblies, each including a cylinder and a piston.

22. The materials handling vehicle according to claim 21, wherein extension of the piston causes the tilt assembly to tilt the fork support relative to the auxiliary mast assembly such that the fork support and the fork assemblies move into a tilt position, and a subsequent retraction of the piston causes the tilt assembly to tilt the fork support relative to the mast assembly such that the fork support and the fork assemblies move into a home position.

23. The materials handling vehicle according to claim 21, wherein the tilt cylinder assemblies each have direction of elongation in the vertical direction.

24. The materials handling vehicle according to claim 21, further comprising first and second cam assemblies coupled to a corresponding tilt cylinder assembly, the cam assemblies driven by the piston of the corresponding tilt cylinder assembly to tilt the fork support relative to the auxiliary mast assembly.

25. The materials handling vehicle according to claim 24, wherein each cam assembly comprises a cam weldment including a roller stud that is not concentric with a bearing surface of the respective cam weldment.

26. The materials handling vehicle according to claim 25, wherein rotation of each cam weldment causes the corresponding roller stud to move with an arc-like movement corresponding to the rotation of the cam weldment, wherein the arc-like movement tilts the fork support relative to the auxiliary mast assembly.

27. The materials handling vehicle according to claim 20, wherein fork support is tiltable by the tilt assembly such that the central axis of the fork assemblies is positionable up to plus (+) or minus (−) 5 degrees relative to the horizontal direction.

28. The materials handling vehicle according to claim 20, further comprising a spacer structure that sets the central axis of the fork assemblies at a predetermined angle relative to the horizontal direction.

29. The materials handling vehicle according to claim 20, wherein the second fork member of each fork assembly is positioned over the corresponding first fork member.

30. The materials handling vehicle according to claim 20, wherein a headlength of the load handling assembly, which headlength is defined as a length from an outer surface of the fork support opposite to the auxiliary mast assembly, to an inner surface of the tilt assembly, is less than ten (10) inches.

31. The materials handling vehicle according to claim 30, wherein the second mast structure is rotatable relative to the first mast structure.

32. The materials handling vehicle according to claim 31, wherein the headlength encompasses the fork support, the second mast structure, and the tilt assembly.

33. The materials handling vehicle according to claim 31, wherein the tilt assembly comprises first and second tilt cylinder assemblies, each including a cylinder and a piston, the cylinder of each tilt cylinder assembly mounted to a corresponding flange that extends outwardly from the fork support toward the auxiliary mast assembly.

34. The materials handling vehicle according to claim 33, wherein the headlength encompasses the fork support, the second mast structure, the tilt cylinder assemblies, and the flanges.

* * * * *